United States Patent [19]

Gazda et al.

[11] Patent Number: 4,583,592

[45] Date of Patent: Apr. 22, 1986

[54] WELL TEST APPARATUS AND METHODS

[75] Inventors: Imre I. Gazda, Fort Worth; Phillip S. Sizer, Dallas, both of Tex.

[73] Assignee: Otis Engineering Corporation, Dallas, Tex.

[21] Appl. No.: 604,502

[22] Filed: Apr. 27, 1984

[51] Int. Cl.[4] ..... E21B 34/14; E21B 43/12; E21B 47/06

[52] U.S. Cl. ..... 166/250; 166/116; 166/142; 166/240; 166/242; 166/332; 166/385; 166/386

[58] Field of Search ..... 166/250, 152, 142, 126, 166/128, 385, 115, 116, 332, 334, 242, 240, 113, 386

[56] References Cited

U.S. PATENT DOCUMENTS

| | | | |
|---|---|---|---|
| Re. 31,313 | 7/1983 | Fredd et al. | 166/250 |
| 3,472,070 | 10/1969 | Chenoweth | 73/155 |
| 3,552,718 | 1/1971 | Schwegman | 166/332 |
| 4,051,897 | 10/1977 | Kingelin | 166/113 |
| 4,083,401 | 4/1978 | Rankin | 166/250 |
| 4,134,452 | 1/1979 | Kingelin | 166/133 |
| 4,149,593 | 4/1979 | Gazda et al. | 166/113 |
| 4,159,643 | 7/1979 | Watkins | 166/250 X |
| 4,252,195 | 2/1981 | Fredd | 166/314 |
| 4,373,583 | 2/1983 | Waters | 166/113 |
| 4,420,044 | 12/1983 | Pullin et al. | 166/322 |
| 4,508,174 | 4/1985 | Skinner et al. | 166/373 |

OTHER PUBLICATIONS

The brochure entitled "MUST" published by Flopetrol Johnston.

World Oil magazine, p. 21, Oct. 1983 Edition.

Composite Catalog of Oil Field Equipment and Services, pp. 506, 507, 1970–1971 Edition, published by World Oil magazine.

*Primary Examiner*—James A. Leppink

*Assistant Examiner*—Hoang C. Dang

*Attorney, Agent, or Firm*—Albert W. Carroll

[57] ABSTRACT

A well test tool for closing a well at a downhole location below the well packer and near the formation to be tested, the apparatus being openable and closable from the surface by tensioning and relaxing the cable or wire line on which it is lowered into the well, the test tool having a lock mechanism which locks automatically upon entering its landing receptacle in the well and is further provided with a releasing mechanism for unlocking the test tool automatically after a present number of open/close cycles have been performed. A bypass landing receptacle is provided which permits high rates of flow during testing. A modified bypass landing receptacle is provided to permit use of the apparatus above the well packer, as in wells having an existing packer therein. Methods of testing wells are also disclosed.

49 Claims, 18 Drawing Figures

WELL TEST APPARATUS AND METHODS

BACKGROUND OF THE INVENTION

1. Field of the Invention

This invention relates to flow testing of wells and more particularly to test tools which are run on a flexible line and are operable thereby from the surface to shut-in a well and to open it up at a subsurface depth, especially at a location just above the formation being tested.

2. Description of the Prior Art

Until a few years ago, downhole well data were generally obtained by lowering a bottom hole pressure gage into a well on a wire line after the well had been closed in at the surface for maybe 48 to 72 hours. The gage usually carried a maximum-recording thermometer. The gage was lowered to a location a predetermined distance below sea level, usually at or near the casing perforations. The gage was usually suspended at this depth a few minutes while the well remained shut-in to record the formation pressure and temperature. The well was then placed on production at a predetermined rate of flow to obtain recordings of the drawdown characteristics of the well. The data thus obtained were then evaluated by reservoir technicians to aid them in their effort to determine more accurately the extent, shape, volume, and contents of the reservoir.

Since the well was controlled by valves located at the surface, usually a great distance from the reservoir, problems arose as a result of the reaction of the column of production fluids in the well tubing. During shut-in periods liquids would settle on bottom and the gas would collect thereabove, introducing uncertainties into the data obtained and clouding the formation's charasteristics. It became desirable to have the ability to open and close the well at a point as near the perforations or reservoir as possible and thus avoid the need to build up and draw down the great volume and height represented by the well bore or well tubing extending many thousands of feet from the reservoir to the surface. Further it was desirable to run a test tool including sensor means on a conductor cable and be able to control the downhole opening and closing means from the surface, and to record and display at the surface and in real time the downhole data as they were sensed by the test tool.

The applicants are familiar with the following prior patents which may have some bearing upon the well testing problems as relates to the present invention.

| | | |
|---|---|---|
| Re. 31,313 | 4,043,392 | 4,278,130 |
| 2,673,614 | 4,069,865 | 4,286,661 |
| 3,208,531 | 4,134,452 | 4,373,583 |
| 3,419,075 | 4,149,593 | 4,420,044 |
| 3,472,070 | 4,159,643 | 4,426,882 |

Also, they are familiar with a brochure published by Flopetrol-Johnston covering their MUST Universal DST device.

Applicants are further familiar with an editorial comment published in WORLD OIL magazine, page 21, October 1983 Edition.

In addition, they are familiar with the landing nipple illustrated on pages 506 and 507 of the Composite Catalog of Oil Field Equipment and Services, 1970–71 Edition, published by WORLD OIL magazine.

U.S. Pat. No. 4,134,452, issued to George F. Kingelin on Jan. 16, 1979; U.S. Pat. No. 4,149,593, issued to Imre I. Gazda, et al, on April 17, 1979; U.S. Pat. No. 4,159,643, issued to Fred E. Watkins on July 3, 1979; U.S. Pat. No. 4,286,661, issued on Sept. 1, 1981 to Imre I. Gazda; U.S. Pat. No. 4,373,583, issued Feb. 15, 1983 to Fleming A. Waters; U.S. Pat. No. Re. 31,313 issued July 19,1983 to John V. Fredd and Phillip S. Sizer, on reissue of their original U.S. Pat. No. 4,274,485 which issued on June 23, 1981; and U.S. Pat. No. 4,278,130, issued July 14, 1981 to Robert T. Evans, et al, all disclose test tools which may be run on a wire line or cable and used to open and close a well at a downhole location by pulling up or slacking off on the wire line or cable by which these test tools are lowered into the well. In each of the above cases, a receptacle device is first run on a wire line and anchored in a landing nipple, then a probe-like device is run and latched into the receptacle.

U.S. Pat. No. 4,134,452 provides only a tiny flow passage therethrough openable and closable by tensioning and relaxing the conductor cable for equalizing pressures across the tool.

U.S. Pat. No. 4,149,593 is an improvement over the device of U.S. Pat. No. 4,134,452 and provides a much greater flow capacity as well as a locking sub which locks the tool in the receptacle with a tenacity somewhat proportional to the differential pressure acting thereacross.

U.S. Pat. No. 4,286,661 is a division of U.S. Pat. No. 4,149,593, just discussed, and discloses an equalizing valve for equalizing pressures across the device disclosed in U.S. Pat. No. 4,149,593.

U.S. Pat. No. 4,159,643 discloses a device similar to those mentioned above and has a relatively small flow capacity. This tool has lateral inlet ports which are closed by tensioning the conductor cable.

U.S. Pat. No. 4,373,583 discloses a test tool similar to those just discussed. It carries a self-contained recording pressure gage suspended from its lower end and therefore sends no well data to the surface during the testing of a well. This tool, therefore, may be run on a conventional wire line rather than a conductor line, since it requires no electrical energy for its operation.

U.S. Pat. No. Re. 31,313 discloses a device similar to that of U.S. Pat. No. 4,373,583 in tnat it has lateral inlet ports which are opened and closed by moving a probe up or down through tensioning or relaxing the wire line or cable on which it is lowered into the well.

The MUST Drill Stem Test Tool of Flopetrol-Johnston disclosed in the brochure mentioned above and in the article published in WORLD OIL magazine provides a non-retrievable valve opened and closed from the surface by tensioning and relaxing the conductor cable connected to the probe-like tool latched into the valve. Even with the valve open and the well producing, no flow takes place through the probe. All flow moves outward through the side of the valve into a bypass passage which then empties back into the tubing at a location near but somewhat below the upper end of the probe. The device provides large or "unrestricted" flow capacity. The probe automatically releases when a predetermined number (up to twelve) of open-close cycles have been performed.

U.S. Pat. No. 4,426,882 which issued to Neal G. Skinner on Jan. 24, 1984 discloses a similar test tool which senses downhole conditions and sends electrical signals to the surface, but the valve for permitting or preventing fluid flow therethrough is not controlled by tensioning and relaxing the cable by which the tool is lowered into the well but is controlled from the surface by electrical means controlling a downhole valve actuator which includes a solenoid.

U.S. Pat. No. 2,673,614, issued to I. A. Miller on Mar. 30, 1954; U.S. Pat. 3,208,531, issued to J. W. Tamplen on Sept. 28, 1965; U.S. Pat. No. 4,043,392, issued to Imre I. Gazda on Aug. 23, 1977; and U.S. Pat. No. 3,472,070, issued to D. V. Chenoweth on Oct. 14, 1969 disclose means for locking well tools in a well flow conductor.

U.S. Pat. No. 2,673,614 shows keys having one abrupt shoulder engageable with a corresponding abrupt shoulder in a well for locating or stopping a locking device in a well at the desired location in a landing receptacle for its locking dogs to be expanded into a lock recess of the receptacle. A selective system is disclosed wherein a series of similar but slightly different receptacles are placed in a tubing string. A locking device is then provided with a selected set of locator keys to cause the device to stop at the preselected receptacle.

U.S. Pat. No. 3,208,531 discloses a locking device which uses keys profiled similarly to the keys of U.S. Pat. No. 2,673,614 but performing both locating and locking functions.

U.S. Pat. No. 4,043,392 discloses a locking device and a selective locating system therefor. This sytem utilizes a profiled key only for locating the device, as was done in the case of U.S. Pat. No. 2,673,614. The various keys vary slightly in profile, but each key and landing receptacle in the system provides two oppositely facing abrupt stop shoulders.

U.S. Pat. No. 3,419,075 issued to Norman F. Brown on Dec. 31, 1968 discloses apparatus having key means with an abrupt stop shoulder engageable with a corresponding stop shoulder in the well flow conduit, and means for retracting the keys to disengage them from such stop shoulder to enable the tool to be moved therepast in the well.

U.S. Pat. No. 3,472,070 discloses a locking device having separate pivoted locking dogs, one looking up and the other looking down, engaged between a pair of upwardly and downwardly facing abrupt shoulders to lock the device against upward or downward displacement. Such locking device and the landing receptacle therefor are more clearly shown in the Composite Catalog of Oil Field Equipment and Services, 1970–71 Edition, pages 506 and 507.

U.S. Pat. No. 4,420,044, issued to William H. Pullin et al on Dec. 13, 1983, discloses a continuous zig-zag control slot and pin arrangement for controlling longitudinal movement of one member relative to another member telescoped thereinto.

The present invention overcomes many of the problems encountered in prior art devices by providing desirable features such as larger flow capacities, positive locking and improved releasing, simpler construction, improved reliability, decreased foulability, and reduced costs.

SUMMARY OF THE INVENTION

The present invention is directed to test tools and landing receptacles therefor for testing wells, the test tools having tubular body members telescoped together for limited longitudinal relative movement, the body members having lateral ports which are alignable when the test tool is collapsed to permit flow therethrough, the lateral ports being closed when the tool is extended to prevent flow therethrough, the upper end of the test tool being attachable to a conductor cable by which it is lowered into a well and its lower end being provided with locking keys for anchoring the device in its receptacle in the well to direct flow through the device when the device is in open collapsed position and to shut-in or plug the well when the device is in closed extended position, the device being provided with control pin and slot means operable in response to the device being moved back and forth between open and closed positions for unlocking the device from the receptacle after a predetermined number of open-close cycles, the device, upon being pulled from the receptacle, having the ability of being immediately ready to be locked again therein for further cycling.

It is therefore one object of this invention to provide a well test tool and landing receptacle therefor which are useful in obtaining reservoir information in a well by shutting in the well immediately above the casing perforations by closing the test tool and allowing the well to flow by opening the tool, the test tool gathering information such as static and flowing bottom hole pressures and/or temperatures continuously during the testing procedure.

Another object of the invention is to provide a test tool and landing receptacle of the character described which is opened and closed by tensioning and relaxing the wire line or cable on which it is run, the lower end portion of the tool being anchored and sealed in the landing receptacle.

A further object is to provide such a test tool which automatically becomes locked when inserted in its receptacle and which automatically becomes released after a preset number of open/close cycles have been performed.

Another object is to provide such a test tool which, upon becoming released from its receptacle, may be immediately relocked therein for additional cycling, thus providing a tool which can be opened and closed any desired number of times.

A further object of this invention is to provide a test tool and receptacle therefor which has an uncommonly large flow capacity for its size.

Another object is to provide such a test tool which can equalize pressures thereacross quickly.

Another object is to provide a test tool and receptacle therefor which can be placed in the well flow conductor (tubing or drill pipe) above or below the packer, enabling the test tool to be placed directly opposite or very near the perforations.

Another object is to provide a test tool which can be lowered into a well on a wire line or a conductor cable.

A further object of this invention is to provide a test tool of the character described which can be run in a well pipe string above a seal nipple which is then installed in an existing or previously set well packer located just above the casing perforations.

Another ooject is to provide a test tool having means for minimizing chances that it will become fouled in its landing receptacle by sand or other material settling around it, and in particular, around the locking mechanism.

Other objects and advantages of this invention will become apparent from reading the description which follows and from studying the accompanying drawing wherein:

DESCRIPTION OF THE PREFERRED EMBODIMENTS

Figure 1:
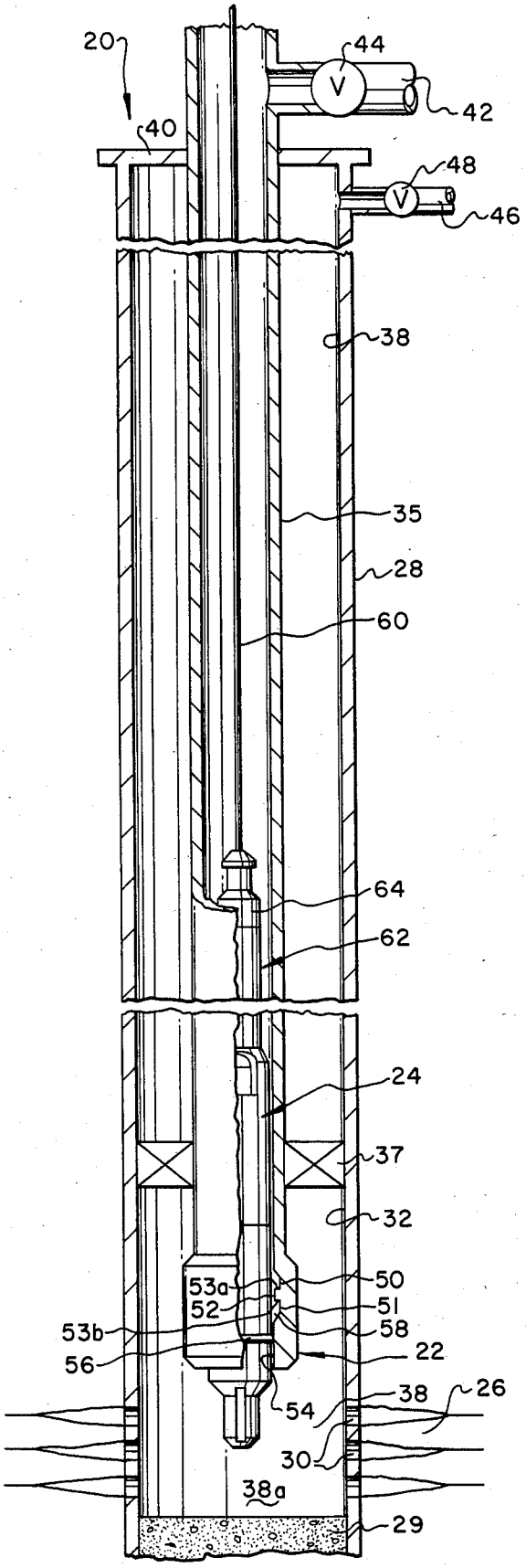
FIG. 1 is a schematical view showing a well being tested with the test apparatus of this invention.

Referring now to FIG. 1, it will be seen that a well 20 is schematically shown to be undergoing production testing through use of production well test apparatus embodying this invention. Such test apparatus includes a landing nipple or receptacle 22 and a probe or test tool 24 locked therein.

Well 20 penetrates an earth formation 26, and well casing 28 is disposed in the well and extends through the formation and has its lower portion sealed as at 29 by suitable plugging means such as cement, or the like. Perforations 30 conduct formation products from formation 26 through the wall of casing 28 and into the casing bore 32. A well tubing 35 extends from the surface to a level at or near the perforations 30, and a packer 37 seals between the tubing exterior and the casing interior thus closing the tubing-casing annulus 38 above the perforations 30. A wellhead 40 closes the upper end of the casing about the well tubing, thus closing the upper end of the annulus 38. A flow line 42 is connected to the tubing 35 just above wellhead 40, and wing valve 44 controls flow between the tubing and the flow line. A casing wing 46 and wing valve 48 provide access to annulus 38 if needed.

The well tubing 35 has a landing nipple or receptacle 22 connected thereto at its lower end, that is, below the well packer 37, as shown. If desired, the landing receptacle 22 may be threaded at its lower end for attachment of a nipple or other suitable means for protecting the lower end of the test tool which protrudes therefrom. Alternatively, the receptacle could be made sufficiently long to house the entire lower end of the test tool. Normally, the landing nipple and the packer are located near the perforations so that the volume of the annulus 38 below the packer 37 will be minimal.

The landing nipple or receptacle 22 is formed with upper and lower annular recesses 50 and 51 in its inner wall leaving a land or flange 52 therebetween providing a pair of abrupt shoulders **53*a* and 53*b*, one facing upwardly and the other facing downwardly. Below the recesses, the bore wall 54 of the nipple 22 is smooth and adapted to be engaged by seal ring 56 of test tool 24 when its lock keys 58 are engaged in the recesses 50 and 51**, as shown, to anchor the test tool in the receptacle.

Attached to the upper end of the test tool 24 is a flexible line such as conductor cable 60 and suitable sensor means 62 which may include weight bars. (Test tool 24 can be run on a flexible steel line as will be later explained.)

The test tool, when closed, effectively plugs the bore of the receptacle and blocks flow of formation fluids through the well tubing. The packer, all the while, prevents the escape of well fluids upwardly through the annulus 38. Well fluids entering the casing through perforations 30 are thus confined to the isolated portion of the annulus or chamber **38*a* defined by the casing bore 32 and having its lower end closed by cement 29 and its upper end closed by the packer 37 and test tool 24**. This chamber has an extremely small volume compared with the huge volume of the bore of the tubing which is normally many thousands of feet in length.

When the test tool 24 is closed as shown, the pressure in chamber **38*a* soon equalizes with the formation and thus contains formation pressure. This build up and subsequent static, shut-in pressure is transmitted continually by the test tool to the sensor means 62 thereabove which then sends electrical signals via conductor cable 60** to the surface where it is received and processed by suitable apparatus which then records and/or displays in real time the magnitude of such formation pressure as a function of time.

The sensor means 62 may also include means for sensing physical characteristics other than pressure. For instance, the test tool would normally include temperature sensing means, in whicn case such means would send signals continually to the surface and the surface apparatus would display and/or record in real time the temperature at the test tool as a function of time.

Both pressure and temperature signals may be transmitted to the surface continually all the while that power is supplied to the sensor means 62.

The test tool is closed by tensioning the cable 60. This lifts the upper portion of the test tool to extended position while the lower portion thereof remains anchored in the receptacle.

The test tool is opened by relaxing the cable 60 and allowing the test tool to contract. When the test tool is open, formation fluids may pass upwardly therethrough and through the tubing to the surface and pass out of the well through wing valve 44 into the flow line 42, provided the wing valve is open.

Thus, if the wing valve 44 is open, flow from the formation may be controlled by opening and closing the test tool merely by tensioning and relaxing the cable 60.

Figure 2A:
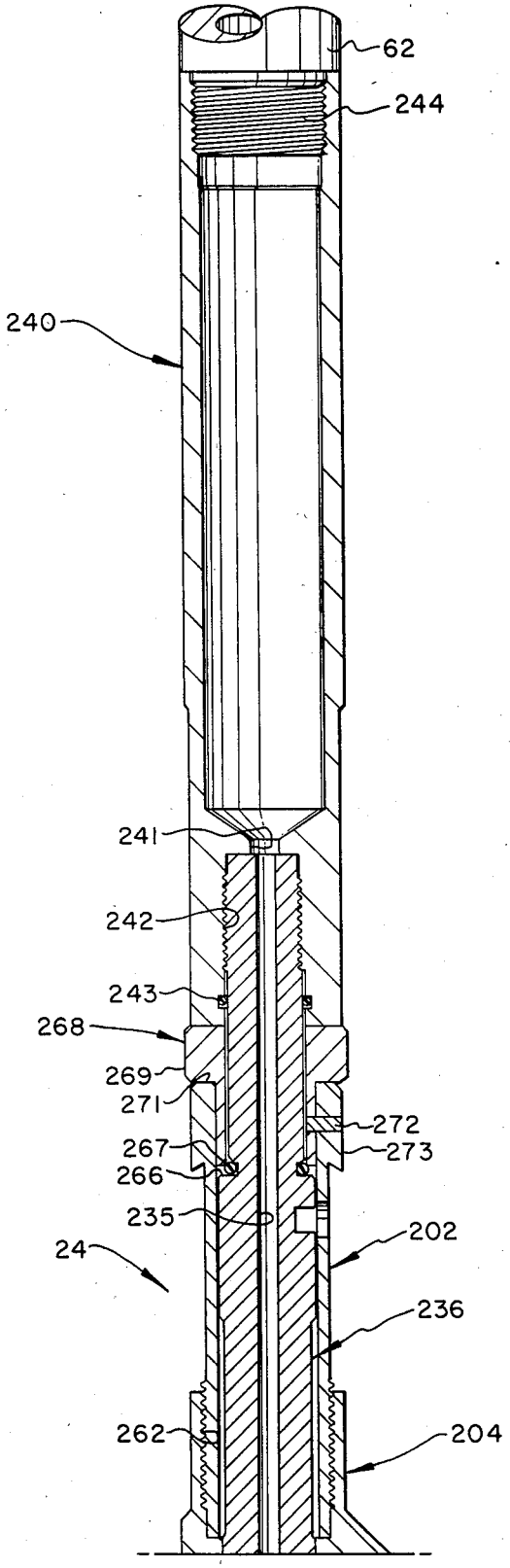
FIGS. 2A, 2B, and 2C, taken together, constitute a longitudinal view, partly in section and partly in elevation, showing a test tool constructed in accordance with the present invention.
Figure 2B:
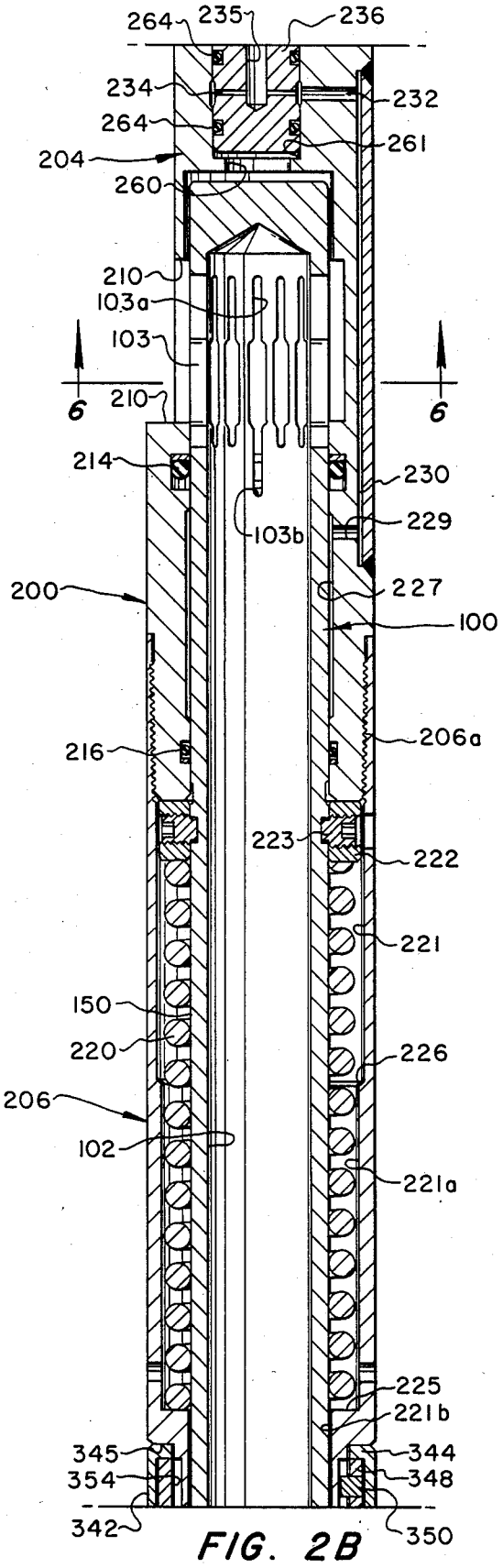
Figure 2C:
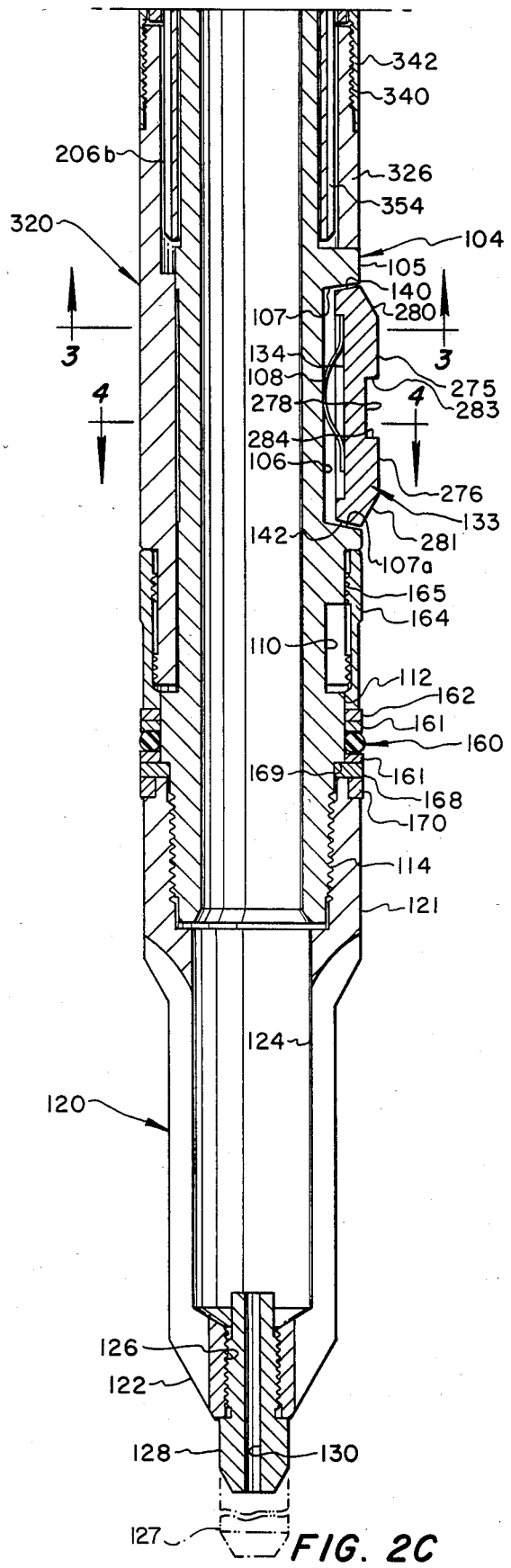
Figure 3:
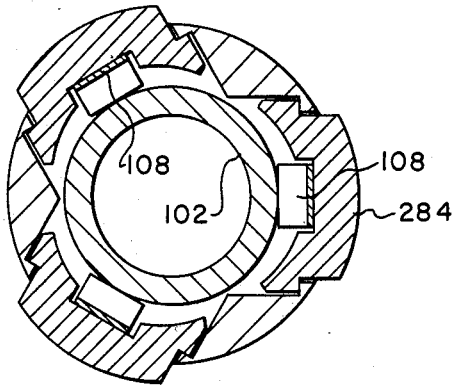
FIG. 3 is a cross-sectional view taken along line 3—3 of FIG. 2C showing the arrangement of the lock keys.

Referring now to FIGS. 2A, 2B, and 2C, it is seen that a test tool is indicated generally by the reference numeral 24. This test tool 24 in this view is a detailed showing of the test tool 24 seen in schematical FIG. 1.

The valve portion of the test tool 24 is substantially similar in structure and operation to the tool illustrated and described in U.S. Pat. No. 4,286,661, supra, the tool being illustrated in FIGS. 17–20 of such patent. U.S. Pat. No. 4,286,661 is hereby incorporated herein for all purposes by reference thereto.

Test tool 24 includes a tubular mandrel 100 having a downwardly opening blind bore 102 which terminates just short of the upper end thereof. Flow ports 103 are formed in the mandrel wall near the upper end of blind bore 102 and communicate the bore 102 with the exterior of the mandrel. The lower end of the mandrel is provided with means for anchoring the test tool in a suitable receptacle in a manner to be later described.

The lower portion 104 of the mandrel 100 is enlarged in outside diameter as at 105 and an external annular recess has been formed in the mandrel as at 106 having its upper and lower limits defined by shoulders 107 and 107*a*, respectively. The recess 106 is spaced a short distance below the upper end of this enlarged portion 104 so as to leave a flange at the upper end of the recess.

Another external annular recess 110 is formed in mandrel 100 a spaced distance below recess 106 as shown. Immediately below recess 110 the mandrel has been reduced in outside diameter as at 112 and the lower end of the mandrel has been externally threaded as at 114 to receive the nose piece 120 as shown.

The upper portion of the nose piece 120 is enlarged in outside diameter as at 121 while its lower end is generously chamfered as at 122 to provide a suitable guide surface for guiding the test tool as it moves downwardly in the well. The nose piece has a bore 124 which is reduced in diameter and internally threaded as at 126 to receive the plug 128 which closes the lower end of the test tool and may be provided with a through bore such as passage 130. (Thread 126 may be utilized, if desired, to attach a tool such as a self-contained recording pressure gage, or the like tool, shown in dotted lines and indicated by the reference numeral 127, to the lower end of the test tool. If such recording gage is to be the only means of gathering data through use of test tool 24, the test tool can be run on a conventional flexible steel line.)

Figure 4:
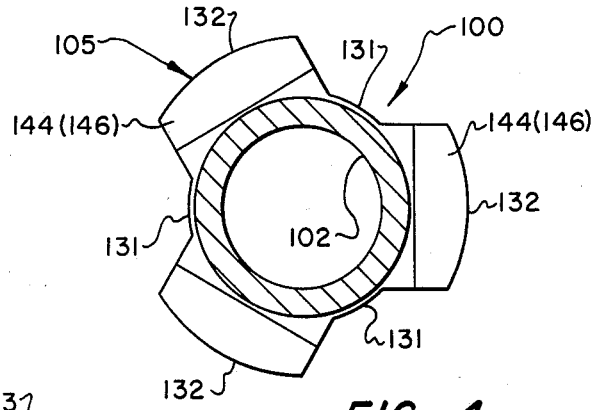
FIG. 4 is a fragmentary view taken along line 4—4 and showing only that portion of the test tool mandrel associated with the lock keys.

The mandrel, as seen in FIG. 4, has been milled to provide circumferentially spaced longitudinal grooves each indicated by the reference numeral 131 providing ears 132 therebetween. These longitudinal grooves pass through the two flanges at the upper and lower ends of recess 106.

Locking keys 133 are mounted in recess 106 of the mandrel, and each key is provided with means such as flat spring 108 for biasing the spring between retracted and expanded positions. Each spring 108 may be mounted in a suitable recess 134 as shown in the inward side of the key to allow the key to be retracted as fully as needed. The keys are provided with flat surfaces 140 and 142 on its upper and lower ends, respectively, and corresponding flat surfaces are also provided on the mandrel as at 144 and 146 at the upper and lower ends of recess 106. (Since FIG. 4 is a cross-sectional view looking upwardly, and since the view looking downwardly would be exactly the same, the lower flat surfaces 146 which are the counterparts to flat surfaces 144 have their identifying numeral in parentheses). These flat surfaces on the mandrel and keys provide good and adequate bearing area to enable the test tool to withstand great loads as a result of large pressure differentials acting thereacross as will hereinafter be brought to light.

The upper portion of mandrel 100 is reduced in diameter as at 150, and near its upper end a plurality of circumferentially spaced slots or flow ports 103 are provided which communicate bore 102 with the exterior of the mandrel. Flow ports 103 may have their upper ends narrowed as at 103*a* as shown, if desired, and it is essential that at least one and preferably two or more of the slots 103 be extended downwardly in length as at 103*b* for a purpose to be made clear later. The upper end of bore 102 of the mandrel 100 is blind or closed, as clearly shown in FIG. 2B.

Suitable seal means such as resilient seal ring 160 is carried by mandrel 100 just above the upper end of nose piece 120. A pair of non-extrusion rings 161 are placed one above and one below seal ring 160, and a metal backup ring 162 is placed between the non-extrusion ring and the lower end of a retainer sleeve 164 which is attached as by thread 165 to mandrel 100 as shown. Retainer sleeve 164 serves a purpose which will be explained later. A backup ring 168 is disposed immediately below seal ring 160 and is jammed between the upper end of nose piece 120 and a downwardly facing shoulder 169 formed on mandrel 150 as shown. The upper end of the nose piece 120 is reduced in outside diameter, forming a recess adjacent the lower side of backup ring 168 in which a wiper ring such as felt wiper ring 170 is carried. The purpose of the wiper ring is to wipe the wall of the landing receptacle 22 ahead of seal ring 160 when the test tool is installed to assure that seal ring 160 will seal properly between the receptacle and the test tool.

A tubular housing 200 comprised essentially of a tubular fishing neck 202, upper body section 204, and lower body section 206, is telescoped over the upper end of mandrel 100 and is slidable longitudinally relative thereto between upper and lower positions. The upper housing 204 is provided with windows 210 which are aligned with the flow ports 103 when the housing is in its lower position seen in FIGS. 2A, 2B, and 2C. A pair of seal rings 214 and 216 are carried in suitable recesses in the housing and seal between the housing and the mandrel. When the housing is moved to its upper position, seen in FIG. 8, seal rings 214 and 216 will seal above and below flow ports 103 of the mandrel to prevent fluid flow through the test tool.

A coil spring 220 disposed in bore 221 of the lower housing section 206 biases the housing to its lower (open) position. The lower housing section is threadedly attached as at 206*a* to the lower end of upper housing section 200 as shown. Housing bore 221 is reduced as at 221*a* near its upper end to provide upwardly facing shoulder 226. Bore 221*a* is reduced as at 221*b* to provide upwardly facing shoulder 225. The outside diameter of the lower portion of body section 206 is reduced as at 206*b* for a purpose to be explained later. The upper end of spring 220 bears against the lower side of support ring 222 which is secured to the mandrel by one or more screws 223 each having its inward end engaged in suitable external recess means of the mandrel as shown. The lower end of spring 220 bears against upwardly facing shoulder 225 formed in lower housing section 206, as shown.

Movement of the housing 200 upwardly on the mandrel 100 towards closed position is limited by engagement of upwardly facing shoulder 226 of lower body section 206 with the lower side of support ring 222.

It was earlier mentioned that at least one of the flow slots 103 is shown to extend farther downwardly than do the other flow slots. This downward slot extension is indicated by the reference numeral 103*b*. The lower end of slot 103*b* is at all times located between seal rings 214 and 216 regardless of whether the test tool is open or closed and, thus, at all times fluidly communicates the mandrel bore 102 with chamber 227 formed in the housing 204 between these two seal rings 214 and 216, and this chamber is communicated via lateral passage 229 with offset longitudinal passage 230 which leads upward to lateral passage 232 which communicates via lateral passage 234 and central passage 235 of extension 236 attached to the lower end of adapter 240 which, in turn, is attached to the tool train. Adapter 240 has a central bore 241 enlarged and threaded at its lower end as at 242 for attachment to the upper end of extension 236. Seal ring 243 seals this connection. The upper portion of bore 241 is enlarged and internally threaded as at 244 for attachment to the sensor means 62 which forms a part of the tool train. The tool train may include pressure and/or temperature sensing means, or the like, one or more weight bars, and a rope socket such as that indicated by reference numeral 64 in FIG. 1. The rope socket attaches the tool train to the cable by which the test tool is lowered into the well. The test tool, after being lowered into the well and anchored in the landing receptacle is opened by relaxing the cable and closed by tensioning the cable. And, pressure of well fluids in the test tool is transmitted via slot 103*b*, lateral passage 229, offset longitudinal passage 230, lateral passage 232, and into and through passage 235, bore 241 of adapter 240, and into the lower end of sensor means 62. The sensor senses this pressure and generates signals for transmission to the surface through the cable for processing, recording, and displaying of the data by suitable surface instrumentation.

The test tool 24 may, if desired, be connected to the adapter 240 by safety release means as shown. Thus, should the test tool become fouled in the well as, for instance, becoming fouled in the landing receptacle by detritus, sand, or other material settling therearound, a pull on the cable exceeding a predetermined magnitude will free the tool train from the test tool. This safety release means will now be described The upper end of upper body bore 260 is enlarged as at 261 and is further enlarged and threaded as at 262 to receive the lower threaded end of fishing neck 202. A pair of seal rings 264 carried on the extension 236 seal on either side of lateral passage 232 of the upper body to prevent the escape of well fluids between the extension and the upper body as the pressure of such fluids is conducted from the upper body 204 into bore 235 of the extension through lateral passage 234. Seal rings 264 seal equal areas and, therefore, balance forces which would tend to separate extension 236 from the test tool as a result of well formation pressure.

The extension 236 is provided with an upwardly facing shoulder 266, and a shear sleeve 268 surrounds the extension and is telescoped into the fishing neck so that its lower end is quite close to upwardly facing shoulder 266. The upper portion of the shear sleeve 268 is enlarged to provide an external flange 269 whose lower side abuts the upper end face 271 of the fishing neck. A shear pin 272 is disposed in aligned apertures formed in the fishing neck and shear sleeve as shown. It is now readily seen that an upward pull on the extension of sufficient magnitude while the test tool is held firmly in its receptacle will cause the upwardly facing shoulder 266 to apply an upward force to the shear sleeve and lift it from the fishing neck as the pin 272 is sheared. Thus the extension is lifted free of the test tool, permitting the tool train to be withdrawn from the well. If desired, a resilient ring such as o-ring 267 may be interposed between shoulder 266 and the lower end of sleeve 268 to absorb the shock of small impacts and, thus, avoid weakening the release means while not affecting its response to a sustained upward pull on the cable. A string of fishing tools may then be lowered into the well to engage and take hold of the enlarged upper end or fishing flange 273 of the fishing neck, after which great pulling forces and/or upward jarring impacts may be used to free the test tool and recover it from the well.

The test tool 24 is anchored securely in its landing receptacle 22 by merely allowing the weight of the tool string and test tool to force it into position in the landing receptacle. Locking occurs automatically as the spring-pressed keys 133 become aligned with the lock recesses in the landing receptacle. Locking is confirmed by an upward pull on the cable. If the test tool is anchored, it will not pull free with a pull of reasonable magnitude.

Each locking key 133 is provided with an outwardly facing surface contoured to be complementary to the profile of the recess means formed in the inner wall of the landing receptacle 22 of FIG. 1. Thus, the key profile is in the form of upper and lower bosses 275 and 276 separated by a groove or recess 278. The outward surface of the key has sloping shoulders at its opposite ends which converge outwardly to form frustoconical cam surfaces 280 and 281 at its upper and lower ends, respectively. The recess 278 has upper and lower side walls 283 and 284 which serve as effective abrupt locking shoulders. Thus, the lock key is profiled to engage in the landing receptacle with its upper and lower bosses 275 and 276 engaged in the upper and lower recess of the landing receptacle 22 and with its abrupt locking shoulders 283 and 284 straddling the oppositely facing abrupt stop shoulders in the landing receptacle. The keys, thus, are able to lock the test tool in the landing receptacle since the test tool cannot be moved out of the receptacle in an upwardly or downwardly direction. The test tool can only be moved upwardly, and that only after the keys are first retracted to disengage their abrupt upwardly facing locking shoulders 284 from the corresponding abrupt downwardly facing stop shoulder of the landing receptacle. As the test tool is pulled upwardly from the landing receptacle, the cam surface 280 at the upper outer corner of each key will guide the key past obstructions.

The lock keys are carried in external annular recess 106 of the mandrel as shown. To enhance the load bearing capabilities of the lock mechanism, the load bearing contact areas of the keys and the mandrel are made planar or flat to provide an increased area of intimate contact therebetween for load-bearing purposes. Thus the opposite ends of the keys are flattened as at 140 and 142, and the end wall surfaces of mandrel recess 106 are flattened in the areas 144 and 146 (see FIG. 4). These flattened surfaces are slightly convergent inwardly, being tilted at about 10 degrees relative to the longitudinal axis of the mandrel. These flat surfaces, however, could be inclined at some other suitable angle, if desired.

Lock keys 133 are normally in their expanded position but may be moved inwardly as a result of the upper or lower cam surface 280 or 281 of the lock keys encountering an obstruction in the well as the test tool is lowered thereinto or pulled therefrom. In fact, since the span of the locking keys in their outermost position likely exceeds the internal diameter of the well tubing, the keys will drag against the tubing during its entire round trip into and out of the well.

When the test tool 24 is lowered into the landing receptacle, the keys will be pressed inwardly against flat springs 108 until the external bosses 275 and 276 become aligned with the internal recesses 50 and 51 in the landing receptacle, at which time the keys quickly move outwardly under the bias of springs 108 and the key bosses engage the recesses of the landing receptacle. In this position, the recess 278 of the key engages the land 52 between the recesses 50 and 51 of the landing receptacle 22, and the test tool is thereby securely anchored in the landing receptacle until the keys are disengaged from the receptacle profile.

When the cable is tensioned, closing the test tool, pressure builds up therebelow, and the thrust created as a result of the increasing differential pressure acting across the test tool increases proportionately. The force of this upward thrust is transferred from the mandrel to the keys through the engaged slanted flat surfaces 146 and 142 of the mandrel and keys, respectively. This load is transferred by upwardly facing abrupt lock shoulder 284 of the keys to the downwardly facing abrupt stop shoulder **53*b* which forms the lower face of the land 52 located between the recesses 50 and 51 in the landing receptacle 22**. Thus, the load is transmitted from the test tool to the landing receptacle, which is a part of the tubing string which is secured in the well.

Similarly, downward loads are transmitted from the test tool to the well tubing through the engaged flat slanting surfaces 144 and 140 of the mandrel and keys, respectively, through the keys, and through the downwardly facing abrupt lock shoulder 283 to the upwardly facing abrupt stop shoulder **53*a* which forms the upper side of the land 52 between the receptacle recesses 50 and 51, to the receptacle 22** which forms a part of the well tubing.

To release the test tool from the landing receptacle, the keys 133 must be retracted sufficiently to permit the abrupt upwardly facing stop shoulder 284 of the key to clear and be moved upwardly past the abrupt downwardly facing lock shoulder **53*b* in the landing receptacle 22**.

Means are provided for retracting the keys 133 to release the test tool for withdrawal from the landing receptacle. Such means includes a key retracting sleeve 320 slidably mounted about the mandrel and having cam surfaces engageable with corresponding cam surfaces on the keys. The cam surfaces on the sleeve and the keys coact to retract the keys responsive to upward movement of the sleeve relative to the mandrel in a manner to be described.

Figure 5:
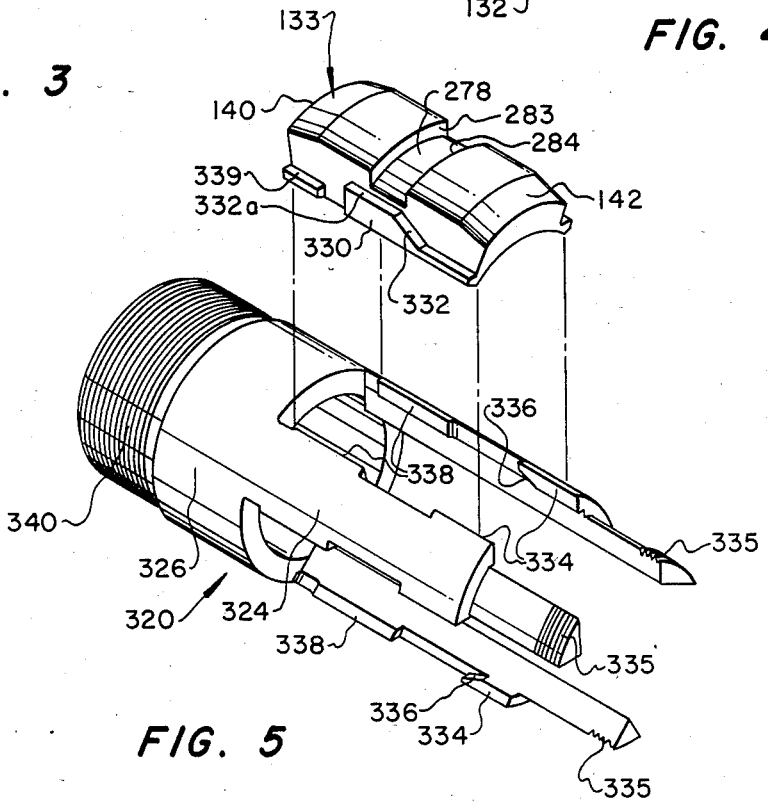
FIG. 5 is an exploded isometric view showing the relation between the keys and the key retractor sleeve.
Figure 6:
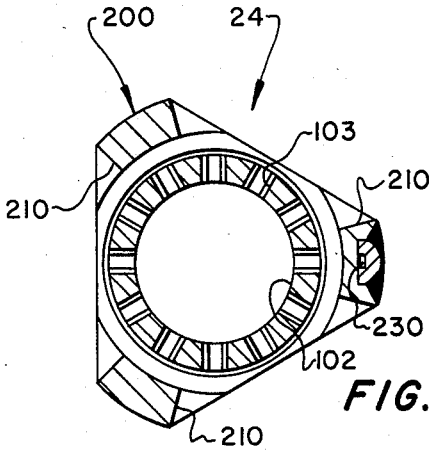
FIG. 6 is a cross-sectional view taken along line 6—6 of FIG. 2B.

The key 133 is shown in FIG. 5 to be formed with lateral extensions or wings 330 on its sides providing cam surfaces 332 which are inclined downwardly and inwardly and lead up to a plateau or flat **332*a***.

The device 24 of FIGS. 2A–8 is provided with three such keys 133, but any suitable number of keys could be provided to anchor the device in its landing receptacle 22.

The keys 133 are retracted by the retracting sleeve 320 seen in FIG. 5. Retracting sleeve 320 is tubular and is formed with a plurality of dependent finger-like projections 324, the number of these fingers being equal to the number of lock keys 133 mounted on the mandrel. The upper tubular portion 326 of the retracting sleeve surrounds the lower reduced portion **206*b* of the lower body section 206 and also the mandrel 100, its dependent fingers straddling the mandrel projections 132 bearing the slanted flat support surfaces 144 and 146** and passing between the keys.

Each finger 324 of the retractor sleeve 320 is formed with opposed lateral projections 334 whose inward upper corner is chamfered to provide a cam surface inclined downwardly and inwardly as at 336 which coacts with coengageable cam surface 332 on the keys to retract the keys and disengage them from the landing receptacle upon upward movement of the retracting sleeve to release the test tool from its anchored position in the receptacle for withdrawal from the well. Fingers 324 are also provided with lateral projections 338 which coengage at all times with stabilizer tabs 339 formed on lateral sides of keys 133 adjacent their upper ends, as shown, to help maintain the keys in proper position.

An external thread 335 is provided on the lower end of fingers 334 as shown. Thread 335 permits the fingers 334 to be telescoped into the retainer sleeve 164 to a position wherein the thread 335 is well beyond the thread of the retainer sleeve. The fingers are thus free to move between its lower position, shown, and its upper position wherein the upper end of thread 335 abuts the lower end of the thread of the retainer sleeve. Thus, upward movement of the retractor sleeve is limited.

Means for effecting upward movement of the retracting sleeve are provided and will now be described.

Figure 8:
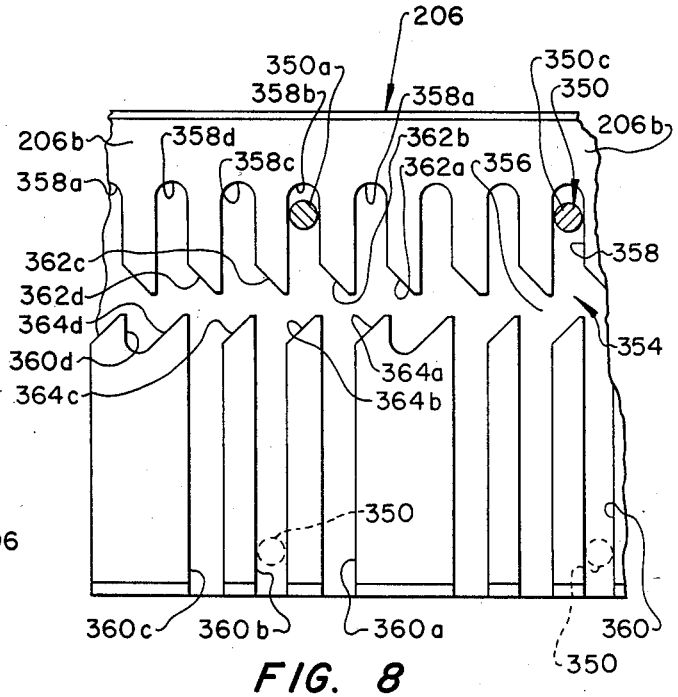
FIG. 8 is a development view showing the control slot of the lock portion of the device of FIGS. 2A–7 and showing the relative positions of the control pin therein during operation of the device.

The upper end of the retracting sleeve 320 is externally threaded as at 340, and a cap 342 having an internal flange 344 is threaded onto the upper end of the retracting sleeve. Downward movement of lower housing section 206 relative to retracting sleeve 342 is limited by downwardly facing shoulder 345 of lower body section 206 abutting the upper end of cap 342. A control ring 348 having at least one inwardly projecting control pin 350 carried thereby is captured inside cap 342 and is supported on the upper end of retracting sleeve 320 and beneath the lower side of the cap's internal flange 344. The control ring 348 floats in this position and is therefore free to move rotationally in a manner to be described hereinbelow. The inward end of control pin 350 is engaged in control slot means 354 formed in the exterior surface of the reduced diameter portion **206*b* of the lower body section 206 which is disposed within the upper portion of retracting sleeve 320. A development of slot means 354 is seen in FIG. 8**.

In the device of FIGS. 2A–8, the control ring 348 is provided with three control pins circumferentially spaced at 120 degrees.

Control slot means 354 is similar to that disclosed in U.S. Pat. No. 4,420,044, supra, and comprises a continuous zig-zag type slot for directing the travel of control pin 350 therein as the lower body section 206 is reciprocated between its lower valve-open position and its upper valve-closed position. This reciprocation causes the control pin to advance a few degrees about the longitudinal axis of the test tool with each reciprocation, and after a preset number of such reciprocations, the control pin is in position to cause the lock keys 133 to be released from the landing nipple to permit the test tool to be withdrawn therefrom when the cable is next tensioned.

Control slot means 354 includes a continuous zig-zag horizontal annular slot 356 which encircles the reduced diameter portion 206*b* lower body section 206. This slot 356 is formed with a number of upper or upwardly extending closed-end longitudinal slots 358 and an equal number of lower or downwardly extending longitudinal slots 360, most of which preferably run out at the lower end of lower body section 206 and are thus open-ended. Since three control pins 350 are provided, then three sets of upper and lower slots are provided to coact therewith. The upper slots 358 are out of phase with the lower slots 360 by about one-half the distance between slot centers as shown. The upper slots 358 are each formed with a guide surface or cam 362 at the right-hand side of its mouth or opening which faces downwardly and to the left. Similarly, each lower slot 360 is provided with a guide surface or cam 364 at the right side of its open upper end which faces upwardly and to the left. It is readily seen that when the control pin 350 is in the horizontal slot 356 and is moved upwardly or downwardly, the pin will encounter one of the cams 362 or 364 and will be forced to the left and guided into the corresponding slot. Thus, the control pin will always be advanced to the next slot and will progress incrementally about the test tool in a clockwise direction.

The upper slots 358 in an exemplary group are identified by the reference numerals 358*a*, 358*b*, 358*c*, and 358*d*. Similarly, the lower slots 360 in the corresponding exemplary group are identified by the reference numerals 360*a*, 360*b*, 360*c*, and 360*d*. Also, the corresponding upper and lower cam surfaces 362 and 364 are indicated by the reference numerals 362*a*, 362*b*, 362*c*, and 362*d*, and 364*a*, 364*b*, 364*c*, and 364*d*, respectively. Notice that lower slot 360*d* is not open ended as the others but has a closed end and is quite short. The control pin for this group of slots is identified by the reference numeral 350*a*.

As seen in FIG. 8, when the test tool is operated to lift the lower body section 206 to valve-closed position (seen in FIG. 8), the control slot means 354 will be moved upwardly while the control pins 350 will normally remain at the level shown.

Figure 7:
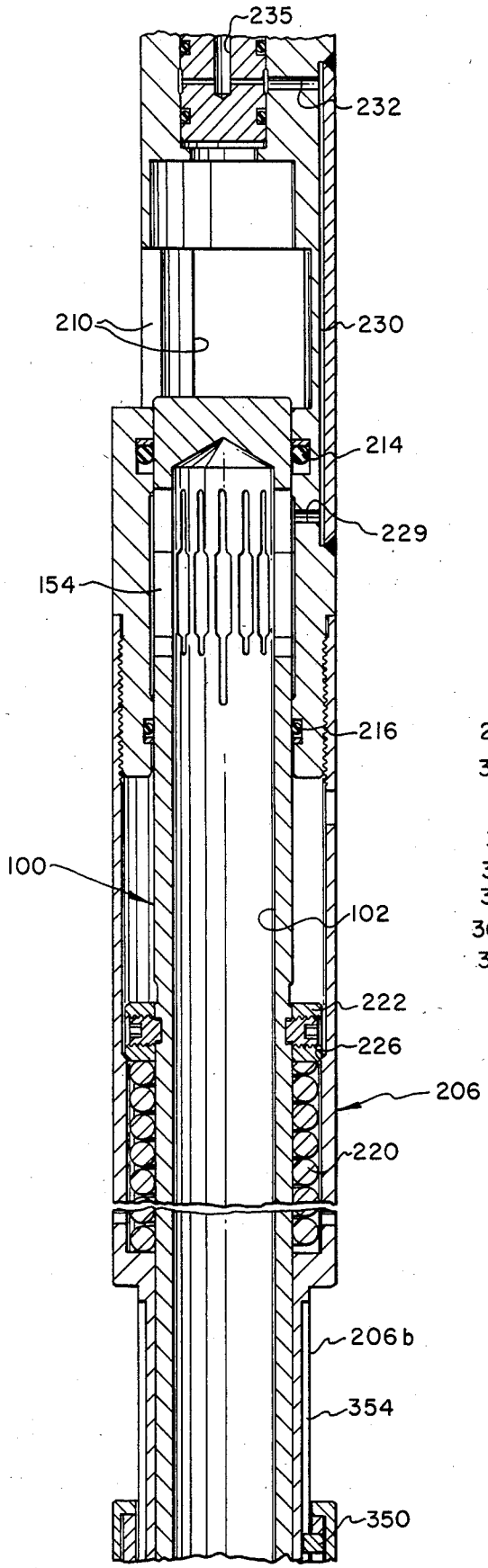
FIG. 7 is a fragmentary view similar to FIG. 2B showing a portion of the device of FIGS. 2A–2C in its closed position.

When the test tool is open, as seen in FIGS. 2A, 2B, and 2C, each control pin 350 will occupy an upper slot 358. For example, assume that the test tool is open to permit flow therethrough and that the exemplary control pin 350*a* is in upper slot 358*b* as shown. When the cable 60 is tensioned to extend and close the test tool as seen in FIG. 7, the control slot means 354 moves upwardly relative to control pin 350*a*. Cam surface 364*b* will engage the pin and cam it toward the left, thus rotating the control ring 348 slightly, and will guide the pin 350*a* into lower slot 360*b*. Slot 360*b* will advance upwardly relative to control pin 350*a* until, when the test tool is fully closed, the control pin will be positioned near the lower end of slot 360*b* (at about the position shown in dotted lines).

It should be understood that the lower slots 360*a*, 360*b*, and 360*c* are open ended only to facilitate assembly of the control ring and control slot means since the control pins 350 are preferably formed integral with the control ring 348 as by welding the pins in suitable apertures formed in the ring.

When the tension on cable 60 is relaxed, spring 220 and the weight of the tool string will move the test tool from its closed position, seen in FIG. 7, to its open position, seen in FIGS. 2A, 2B, and 2C. As the control slot means 354 moves downward relative to control pin 350*a*, the control pin moves, as it were, out of lower slot 360*b*, comes into contact with downwardly facing cam surface 362*c* and is cammed to the left, rotating the control ring slightly and guiding the control pin into upper slot 358*c*. The test tool is, at this time, open again but the control pin has advanced in a clockwise direction from upper slot 358*b* to 358*c*. The control pin will thus progress from slot to slot as the test tool is opened and closed.

When, however, the control pin 350*a* occupies upper slot 358*d*, subsequent tensioning of the cable will cause the test tool to be released from its anchored position in the landing receptacle 22. This occurs because, as the lower body section 206 and its control slot means 354 move upwardly, the control pin, as it were, leaves upper slot 358*d* and is guided into lower slot 360*d* by cam surface 364*d*. Now, because lower slot 360*d* is shallow and has its lower end closed, further lifting of the lower body section 206 and the control slot means 354 will cause lifting of the pin, and therefore the control ring 348, cap 342 and retracting sleeve 326. As was explained hereinabove, upward movement of the retracting sleeve causes the cam surfaces 336 on its fingers 324 to coact with corresponding cam surfaces 332 on the keys 133, causing them to retract. This retraction of the keys will disengage the key's abrupt upwardly facing shoulder 284 from the landing receptacle's abrupt downwardly facing shoulder 53*b* and will permit the test tool 24 to be lifted from the receptacle.

It will be readily understood that in unlocking the test tool from its receptacle, the keys will not necessarily be retracted to their fullest, for as soon as they clear the downwardly facing abrupt shoulder in the receptacle, the test tool will begin its upward travel. It is further readily understood that as soon as the drag on the keys and/or the seal ring 160 therebelow diminishes sufficiently, coil spring 220 will expand and move the lower body section down to its normal position. This downward movement of the lower body section causes the control pin to move, as it were, from shallow lower slot 360*d* to the next upper slot 358, which upper slot is located, relatively, in a position identical to that of upper slot 358*a*. The control pin 350*a* is at this time in position for the test tool to be re-installed in the receptacle for further tests or to be withdrawn from the well, as desired.

When the control pin 350*a* is in the upper slot 358*a*, it is in position to begin a full series of open/close cycles of the test tool before unlocking of the tool from the receptacle occurs. In the test tool 24, shown, the test tool will be allowed four such cycles, but it will release on the fourth tensioning of the cable. Actually, this allows for installing the test tool in its receptacle, closing the tool to permit buildup of pressure therebelow, subsequently opening the tool for flow, repeating such close/open cycle two more times, and then tensioning the cable the fourth time to pull the test tool from the receptacle. If, however, it is desired to reduce the number of open/close cycles to bring about early release of the test tool from the receptacle, the pin 350*a* can be initially positioned in the appropriate upper slot 358 before lowering the test tool into the well. For example, if the control pin 350*a* initially occupies upper slot 358*b*, the tool's number of cycles will be reduced by one before automatic release occurs. Similarly, if the pin is initially located in upper slot 358*c*, the number of cycles before release will be reduced by two.

It is understood that the test tool can be formed to provide any reasonable number of open/close cycles before releasing from the receptacle automatically.

It is readily seen that in the well testing apparatus illustrated in FIGS. 1–8, the maximum rate of flow to be had is limited by the bore 102 of the test tool mandrel 100. While this bore is as large as it practically can be, its cross-sectional area is still small compared to the cross-sectional area of the bore of the landing receptacle or the tubing.

Since it is desirable to test many wells by flowing them at high withdrawal rates which exceed the flow capacity of test tool 24, a test device with increased flow capacity is needed. To provide such higher flow capacity, a bypass type landing receptacle has been provided and is illustrated in FIGS. 9–12.

Figure 9:
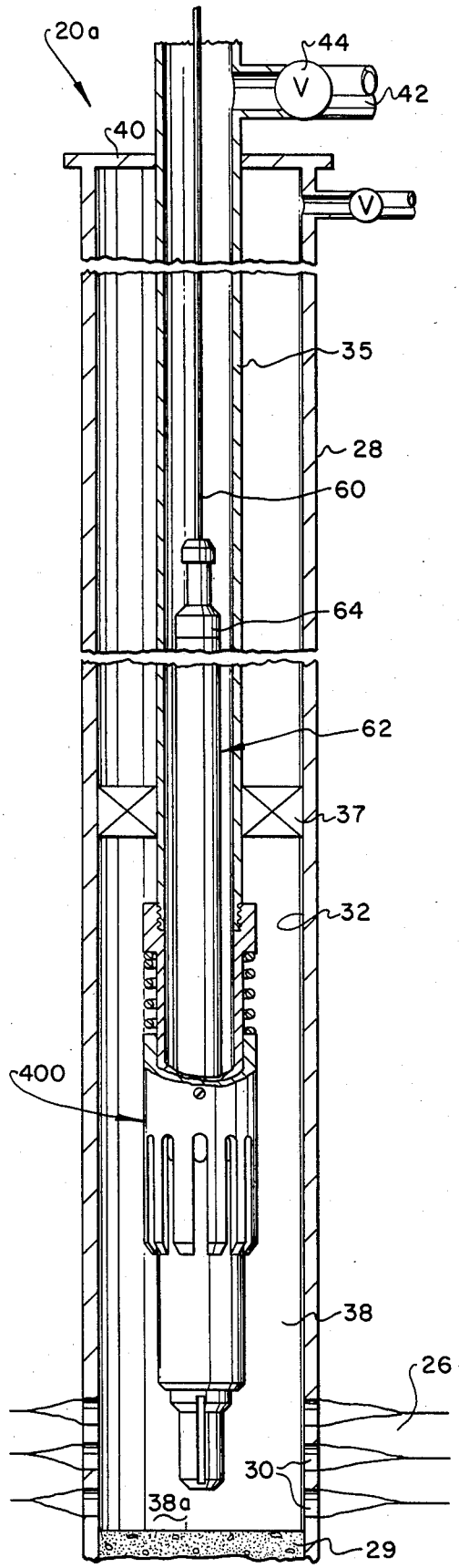
FIG. 9 is a schematical view similar to FIG. 1 but showing the test tool of FIGS. 2A–8 anchored in a bypass landing receptacle.

In FIG. 9, a well 20*a* is schematically shown. This well may be identical in structure to the well 20 of FIG. 1 except that the landing receptacle 400 for receiving the test tool 24 is of the bypass type for providing greatly increased flow rates. All of the other portions of the well and apparatus may be identical to those seen in FIG. 1 and are identified by the same reference numerals.

The apparatus seen in FIG. 9 is used to test the well 20*a* in the same manner as was the apparatus of FIG. 1 to test the well 20. It also is used to practice the same methods. This is true because the only difference between these two apparatuses lies in the landing receptacle, but this difference does not require a change in the operation or in the processes performed, as will be seen.

The modified form of landing receptacle is seen in greater detail in FIGS. 10A, 10B, 10C, 11, and 12 where it is indicated generally by reference numeral 400. This landing receptacle essentially comprises an upper sub 404 telescoped into the upper end of the receptacle body 408 for limited longitudinal sliding movement and a coil spring 412 for biasing them toward extended position.

The upper sub 404 is formed with a bore 420 which is enlarged and threaded as at 422 for attachment to the lower end of the well packer 37 or tubing 35 as desired. The lower portion of the bore 420 may be enlarged slightly as at 424. The outside diameter of the upper sub is reduced as at 426 providing a downwardly facing shoulder 428 for abutting and supporting the upper end of spring 412 which surrounds reduced portion 426 of the upper sub. The sub is provided with an external annular recess 430 spaced a short distance from its lower end. The lower end of the upper sub is provided with seal surface means. The outer corner of the upper sub is chamfered as at 434, and the enlarged lower end of bore 424 is flared as at 436.

The receptacle body 408 is formed with a bore 440 which is reduced in diameter as at 442 and preferably made smooth for receiving the seal means 160 of the test tool 24. Bore 442 may be termed a "full-open" bore since it will pass all standard tools designed to be run through well tubing of the same size as the receptacle. Bore 440 is provided with lock recess means 443 in the form of upper and lower internal annular recesses 444 and 445 providing upwardly and downwardly facing abrupt lock shoulders 447 and 448, as shown. Lock recess means 443 is engageable by keys 133 of the test tool 24 for releasably locking the test tool in position in the landing receptacle while seal 160 of the test tool sealingly engages the inner wall of smooth reduced bore 442 in the very same manner as was described earlier with respect to test tool 24 and landing receptacle 22.

If desired, the bore 440 of the receptacle body 408 may be provided with a long shallow internal recess 450 spaced a short distance above the lock recess means, and a series of similar but shorter recesses 452 thereabove providing a plurality of internal lands 454, thus forming a labyrinth indicated generally by the reference numeral 455. The purpose of the labyrinth is to discourage sand or other solids from settling in and around the locking keys and seal ring of the test tool which could cause difficulty in withdrawing the test tool from the landing receptacle.

Figure 12:
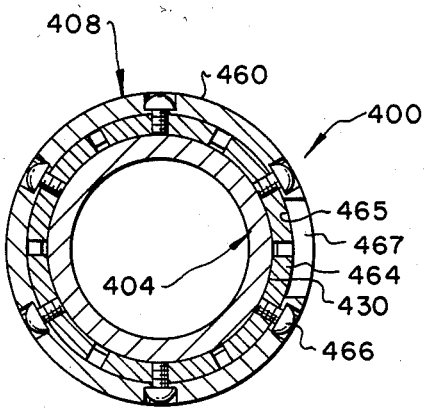
FIG. 12 is a cross-sectional view taken along line 12—12 of FIG. 10B.

The receptacle body has its upper portion enlarged in outside diameter as at 460, and its bore 440 has its upper portion enlarged as at 462. Enlarged bore 462 is telescoped over the lower end of upper sub 404. A plurality of lug segments 464 is disposed in a suitable internal annular recess 465 formed in the upper portion of the receptacle body and the individual segments are secured by screws 466. These lug segments project inwardly and are engaged in external recess 430 of the upper sub 404. The lug segments are positioned in the aligned recesses 430 and 465 of the upper sub and receptacle body by inserting them through horizontal slot or opening 467 formed in the wall of the receptacle body as seen in FIG. 12. After each segment is inserted, it is moved to position, and its screw 466 is installed to secure it in place. The lug segments 464 thus form the equivalent of an internal flange and, being engaged in external recess 430 of the upper sub, is effective to limit relative longitudinal movement between the upper sub and the receptacle body. The receptacle body is shown in its lowermost position relative to the upper sub in FIGS. 10A–10C, being biased to this lowermost position by coil spring 412 whose lower end bears against the upper end face 470 of the receptacle body.

Wiper rings 472 and 473 are carried in suitable internal annular recesses formed in the receptacle body and engage the outer surface of the upper sub not only to discourage detritus, debris, or the like, from entering and fouling between these two members and causing undue difficulty in operation, but also help to centralize and to guide the test tool, especially in restricted diameters such as in the landing receptacle.

The receptacle body is thus provided with lateral bypass port means for allowing well fluids to enter through its side wall and flow to the surface through the well tubing 35 without having to pass through the test tool 24 although such bypass flow is controlled by the test tool and can be turned on and off from the surface in a manner soon to be explained.

Figure 10A:
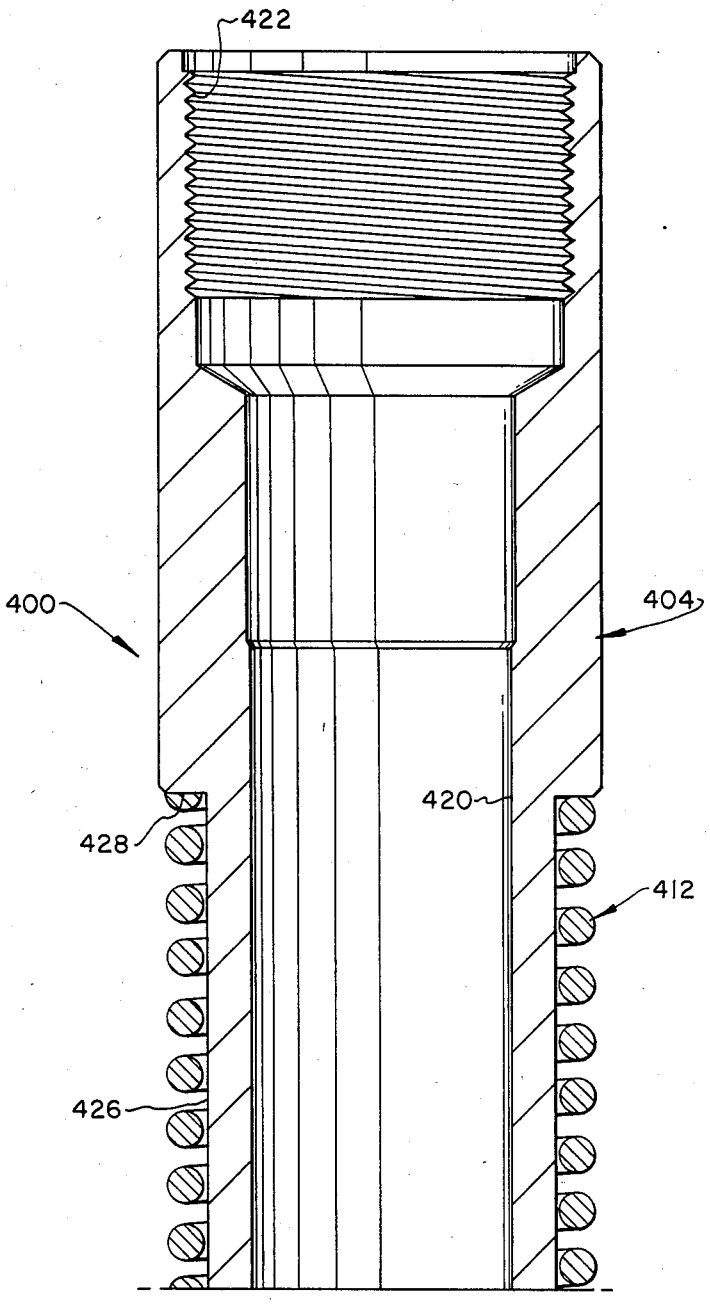
FIGS. 10A, 10B, and 10C, taken together, constitute a longitudinal view, partly in section and partly in elevation, showing a bypass landing receptable in which the test tool of FIGS. 2A–8 may be anchored.
Figure 10B:
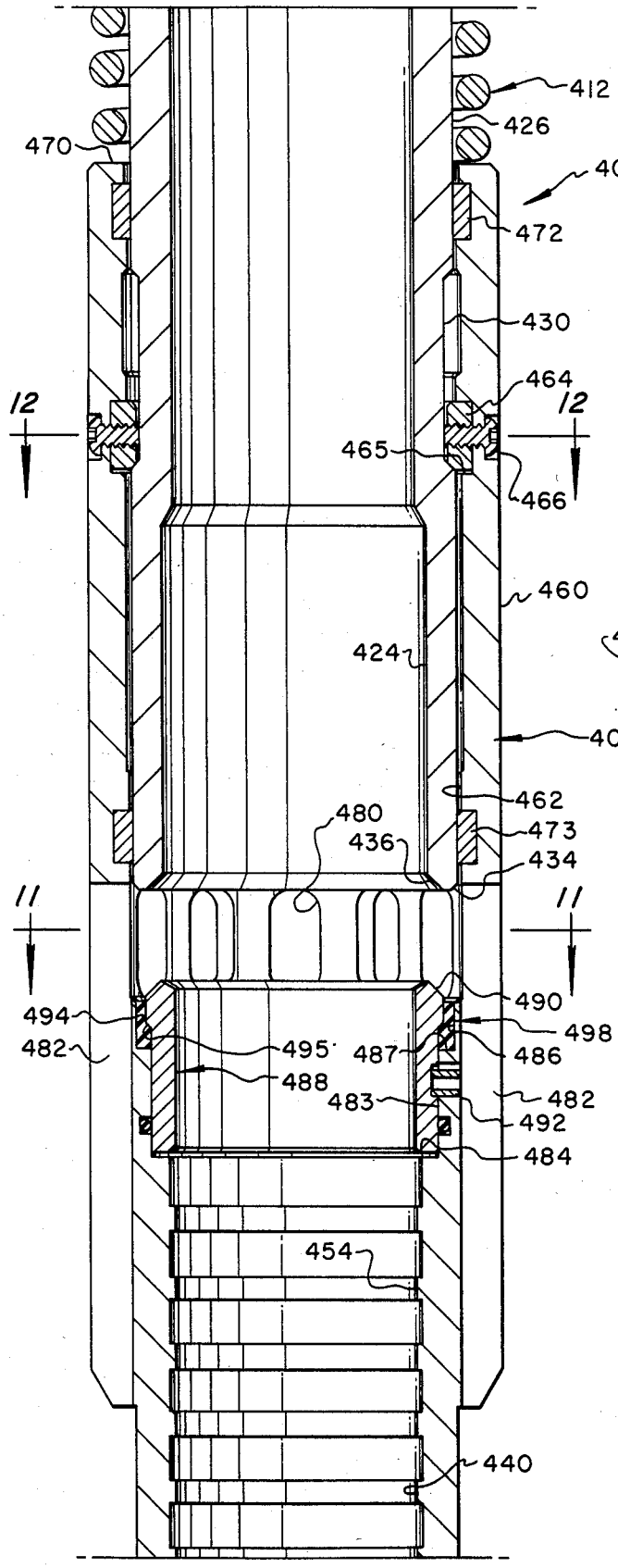
Figure 10C:
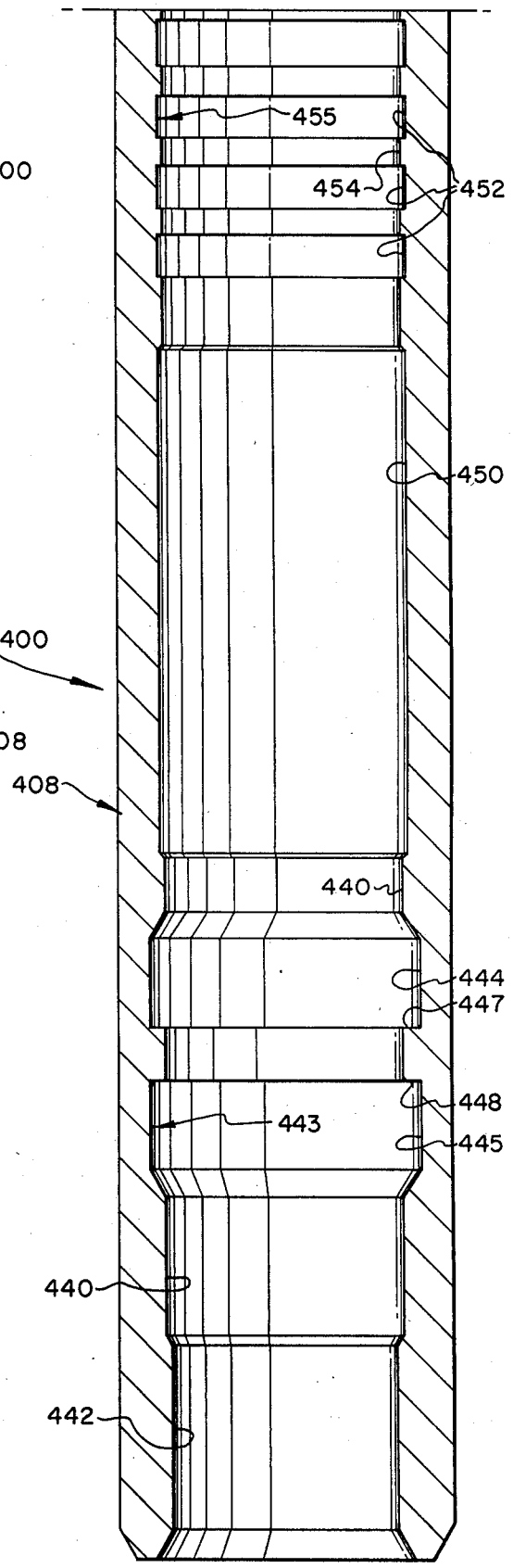
Figure 11:
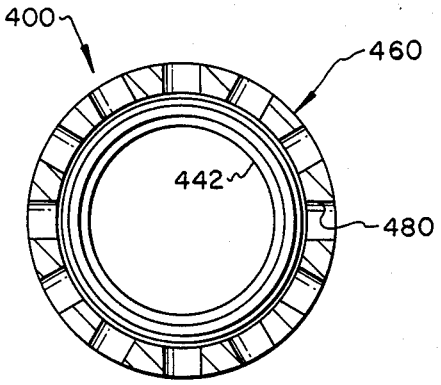
FIG. 11 is a cross-sectional view taken along line 11—11 of FIG. 10B.

The receptacle body is provided with a plurality of circumferentially spaced lateral flow ports 480 which are preferably elongated, as shown, to provide greater flow area therethrough. These flow ports are located in the lower portion of enlarged bore 462 of the receptacle body, and, when the receptacle body is in its lowermost position, the tops of ports 480 are approximately even with the lower end of upper sub 404, as seen in FIG. 10B. To take full advantage of the great flow area of ports 480, a longitudinal groove or slot 482 is aligned with each lateral port and extends from the upper end of the port to the lower end of enlargement 460 where it runs out as shown. These slots 482 are particularly desirable in cases where there is a lack of generous clearance between the outside of the landing receptacle 400 and the inner wall of the surrounding casing.

Below the ports, the receptacle body is provided with seal means which are engageable with the seal means on the lower end of the upper sub when the receptacle body is moved, as by tensioning the cable 60, to its upper position, not shown, to close the lateral ports 480 and stop flow therethrough. The just-mentioned seal means is preferably provided on a separate, replaceable insert as shown. The receptacle body is counterbored as at 483, providing an upwardly facing shoulder 484 and is further counterbored as at 486, providing an upwardly facing shoulder 487. An annular valve insert 488 is disposed in counterbore 483 and is provided with a seat surface 490 which is inclined inwardly and upwardly and which is engageable with the seating surface 436 of the upper sub to close the lateral ports 480 when the receptacle body is lifted to closed position.

A hollow pin, roll pin, or similar securing means 492 is disposed in a lateral aperture of the receptacle body, and its inward end is engaged in a suitable external recess formed in the valve insert 488. The recess of the insert is wider than the pin 492, thus permitting a small amount of longitudinal movement of the valve insert relative to shoulder 484 of receptacle body 408, this shoulder limiting downward relative movement of this insert.

The upper portion of valve insert 488 is enlarged in outside diameter as at 494, providing a downwardly facing shoulder 495 spaced slightly above shoulder 487 at the bottom of counterbore 486. Thus an annular space is formed between the upper end portion of valve insert 488 and the wall of counterbore 486. Since the valve insert 488 is movable longitudinally, its external shoulder 495 moves toward shoulder 487 of the receptacle body when the valve insert moves downward relative to the receptacle body.

A resilient seal ring 498 is carried in and substantially fills the annular space just defined about the upper end of valve insert 488, as shown. When the receptacle body is lifted to its closed position, seat surface 490 of the valve insert 488 engages seating surface 436 on the lower end of the upper sub and stops flow through lateral ports 480. The receptacle body is lifted by tensioning the cable 60 and lifting the test tool anchored therein while at the same time closing the test tool. Thus all flow through the device is stopped. Differential pressure quickly develops across the closed tool and receptacle, generating upward thrust. This thrust pushes the receptacle body higher into more intimate contact with the upper sub and causes the valve insert 488 to move toward limiting shoulder 484. As this happens, downwardly facing shoulder 495 on the valve insert is moved toward shoulder 487 at the bottom of seal 498. In this manner, the lower portion of seal 498 is compressed, displacing some of its material upwardly to engage surface 434 on the lower end of the upper sub and to cover the crack at the interface of seal surfaces 490 and 436. Thus leakage therebetween is prevented.

It is now easily understood that when the test apparatus is in use, the cable 60 is tensioned to both close the passage through the test tool and lift the receptacle body to its upper position closing its lateral ports. Thus, both are closed by tensioning the cable, thus stopping all flow of well fluids into the well tubing 35.

To open the test tool, the cable is relaxed or slacked. The test tool will open immediately as the cable is slacked sufficiently because of the weight of the tool string and the loading of spring 220. The landing receptacle, however, will not open immediately as the test tool opens if the pressure beneath the test tool exceeds the pressure thereabove by a considerable amount. This is because the area sealed by its valve insert 488 and seal 498 is quite large, and the load of spring 412 combined with the weight of the entire tool train is insufficient to force the receptacle body to open position until the differential pressure thereacross is reduced to about 60–100 pounds per square inch, depending upon the load of spring 412, the weight of the tool train and test tool, and the area sealed by the seal 498. If the area sealed by seal 498 is 6.25 square inches and the load of spring 412 is 450 pounds while the weight of the tool train is 100 pounds, the differential pressure at the time of opening the lateral ports of the landing receptacle will approximate (450+100/6.25), or 88 pounds per square inch.

Thus, in operating the test apparatus seen in FIG. 9, the tool is closed by tensioning the cable. This closes the test tool 24 and also lifts the receptacle body to close the bypass ports. With all flow closed off, well pressure builds quickly in the well bore below the packer 47.

To cause the well to flow again, the wing valve 44 should be closed. The cable is then slacked to permit the weight of the tool train and test tool spring to open the test tool. Flow then takes place through the test tool bore only and builds pressure above the packer. When the differential pressure acting across the test tool and packer has been reduced to about 100 pounds per square inch or less, the weight of the tool train combined with the load of the landing receptacle spring should open the bypass ports by forcing the receptacle body to its lowermost position. This wing valve 44 may then be reopened to permit the well to flow.

The landing receptacle 22 of FIG. 1 and the bypass landing nipple 400 of FIGS. 9–12 are necessarily located below the packer in the manner before explained. In some cases, it is desirable to locate the test tool above the packer. This would be true where it is desired to test a well having a previously installed packer, such as a permanent packer, therein, or in cases where it is desired to remove the landing receptacle from the well upon completion of the flow tests but leaving the packer in the well for further use.

Figure 13:
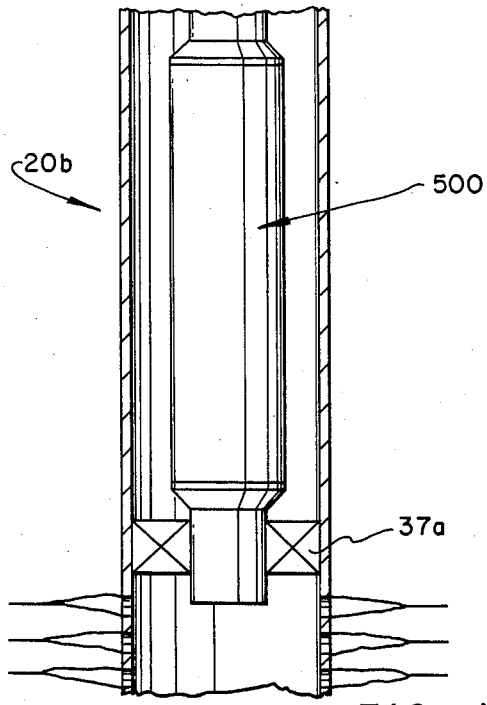
FIG. 13 is a fragmentary schematical view similar to FIG. 1 but showing a modified form of bypass landing receptacle located above a packer in a well.

The well illustrated in FIG. 13 and indicated generally by the reference numeral **20*b* is a well structured much like the wells 20 and 20*a* described hereinabove but has a modified form of bypass landing receptacle 500 located above the well packer 37*a***. The well packer may be run on the well tubing and set in the usual manner, or it may be run and set separately, as are drillable packers. The packer may be an existing packer set sometime previously.

Figure 14:
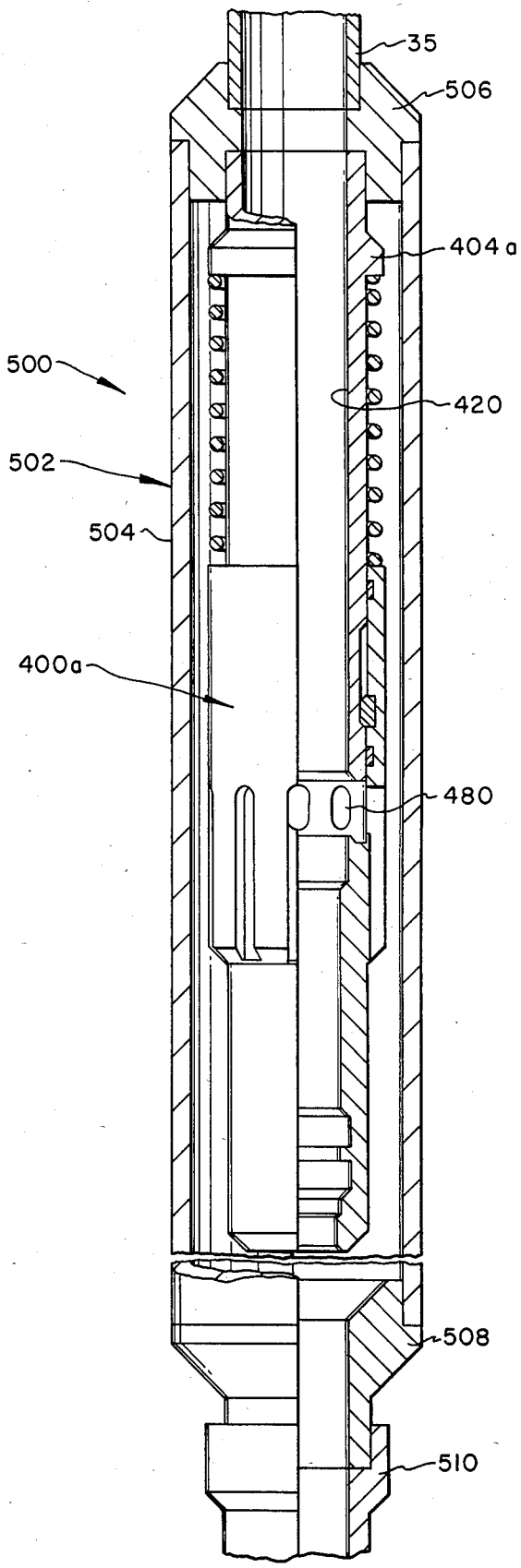
FIG. 14 is a schematical longitudinal view, partly in section and partly in elevation with some parts broken away, showing the modified form of bypass landing receptacle of FIG. 13.

The modified form of bypass landing receptacle 500 is illustrated in FIG. 14. This bypass landing receptacle includes a housing 502 connected into the tubing string 35 as shown. This housing comprises a main body 504 with upper and lower end pieces 506 and 508 connected thereto as shown. The upper end piece is connected to the tubing string 35 while the lower end piece is connected to means 510 which in turn releasably connects to packer **37*a*. This means would in most cases be a locator sub, a packer seal nipple, or the like, which would be inserted in the packer bore when the tubing 35** is lowered into place in the well, or it could be a well packer.

Inside the housing 504 a modified bypass landing receptacle 400*a* is attached to the lower end of upper end piece 506 and is suspended therefrom as shown. The upper sub 404*a* of the device 400*a* has had its upper end modified for such attachment to the upper end piece 506. No other modification is necessary. Therefore, the remainder of the bypass landing receptacle 400*a* is identical to device 400 seen in FIGS. 9–12.

In using the device 500 of FIG. 14, well fluids flow upwardly through the seal nipple and/or locator sub 510, through lower end piece 508, and into housing 504. Fluids then flow from the interior of housing 504 into the lower end of the test tool (not shown) as well as into the bypass ports 480, and into the bore 420 of the upper sub, then through the well tubing 35 to the surface.

It should be understood that when the test tool 24 is in place in either of the bypass landing receptacles 400 or 400*a* and the test tool is open to permit flow therethrough, the rate of flow through the test tool combined with the rate of flow through the lateral flow ports of the receptacle is preferably at least equal to the flow capacity of the open bore of the receptacle without the test tool disposed therein. However, it should be further understood that the same test tool 24 can be used in varying sizes of well tubing. For instance, a test tool built for use in 2½-nominal tubing can be used in larger sizes such as 3-inch, 3½-inch, and virtually any larger size. In such cases, the bypass landing receptacle 400 or 400*a* must be modified by enlarging the counterbore 483 and everything thereabove while leaving everything therebelow to fit the test tool 24. The flow capacity of the lateral flow ports 480 should in most cases approximate the flow capacity of the tubing thereabove, however, the flow ports could be made even larger to decrease the tendency of the flow to actuate the receptacle to bypass-closing position, especially in those cases where the tubing bore is much larger than the receptacle bore. The test tool 24 can be used to control extremely high flow rates through these lateral ports simply by tensioning and relaxing the cable or wire line attached to the test tool. The entire operation and the methods which can be performed by such apparatus are exactly as before explained.

Further, it should be understood that the test tool 24 could, if desired, be run into a well on a slick, single-strand, flexible, conventional, non-conductor, wire line, in which case a conventional self-contained recording pressure gage would be attached in the tool train either above or below the test tool. In such case, the data recorded by the gage could be learned and processed only after the gage was retrieved from the well.

It is now understandable that through use of a bypass landing receptacle such as the bypass landing receptacle 400 or 500, a well could be tested by attaching a recording pressure gauge to the lower end of a suitable anchor having locking and sealing means thereon, lowering such anchor and pressure gauge into the well on a flexible line, such as, for instance, a conventional single-strand wire line, lockingly and sealingly engaging the anchor in the receptacle to effectively plug the receptacle below its lateral flow ports, flowing the well through the lateral flow ports of the receptacle, tensioning the flexible line to lift the anchor and main body of the receptacle to close the lateral flow ports and shut-in the well, relaxing the flexible line and opening the lateral flow ports, releasing the anchor and removing it from the receptacle, and recording well pressures below the well packer during both the shut-in and the flowing periods. Of course, if the anchor includes no means for equalizing pressures thereacross, it would be necessary to equalize such pressures by pressurizing the well tubing above the anchor as by injecting fluids thereinto at the surface until the spring on the receptacle plus the weight of the tool string could move the anchor down and open the lateral flow ports.

It is also understandable that instead of using a conventional single-strand wire line and a recording pressure gauge, a conductor line could be used with signaling sensor means in the tool train as before explained but with suitable anchor means engaged in and effectively plugging the receptacle, to perform testing operations as just explained. Of course, in such case, the anchor would be provided with a flow passageway for conducting well fluid pressure from therebelow to the sensor means in the tool string thereabove.

Thus, it is seen that in the two instances just described, an anchor suspended on a flexible line and locked in the receptacle was used to close the lateral flow ports of the receptacle and that pressure sensing means, either the recording pressure gauge or the signaling sensor means, was associated with the anchor for recording well pressure below the anchor during the shut-in and flowing periods of the testing operation.

Thus, it has been shown that improved test apparatus has been provided; that such test apparatus is capable of closing and opening the well at a location near the casing perforations; that the apparatus can be opened and closed merely by tensioning and relaxing the cable by which it is lowered into the well; that, because of the ability to open and close the well in such manner, various test methods can be carried out; that the test apparatus can be opened and closed any number of cycles; that after a preset number of cycles, the test tool will automatically release from the receptacle, either for withdrawal from the well or for immediate re-installation in the receptacle for further cycling; and that means are provided to minimize the settling of sand, debris, or the like, about the test tool which might make it difficult to operate or to withdraw from the receptacle.

It is obvious that while the test tool 24 and the landing receptacles 400 and 400*a* are opened by tensioning the flexible line and are closed when the flexible line is relaxed, they could be constructed to work in the opposite manner, if desired.

The foregoing description and drawings of the invention are explanatory and illustrative only, and various changes in sizes, shapes, and arrangement of parts, as well as certain details of the illustrated construction, may be made within the scope of the appended claims without departing from the true spirit of the invention.

We claim:

1. A test tool for testing a well to be run on a flexible line and anchored in downhole receptacle means in a flow conductor therein for controlling flow through the flow conductor, said tool being openable and closable by tensioning and relaxing the flexible line to permit and prohibit flow therethrough, said tool having a flow passage for conducting well pressure from therebelow to pressure sensing means thereabove all the while said test tool is in the well, the downhole receptacle having a pair of internal annular recesses providing a pair of oppositely facing abrupt lock shoulders therebetween, said test tool comprising:

a. tubular mandrel means having lateral flow port means near its upper end;

b. lock keys mounted on said tubular mandrel means and configured to engage said pair of recesses and said pair of oppositely facing lock shoulders in said downhole receptacle means, said keys being movable between retracted and expanded positions;

c. means biasing said keys outwardly toward expanded position;

d. key retractor sleeve means slidably mounted on said tubular mandrel means and having cam means thereon engageable with said lock keys to retract them to unlocked position responsive to upward movement of said key retractor sleeve means relative to said tubular mandrel means;

e. control ring means rotatably carried by said retractor sleeve means and having inwardly projecting pin means fixed thereto;

f. tubular body member means having means on one end thereof for connection to a conductor cable or wire line and having its other end telescoped over the upper end portion of said tubular mandrel means for limited longitudinal movement relative thereto, said tubular body member means having its lower end portion reduced in diameter and telescoped into the upper end portion of said key retractor sleeve means, said reduced diameter portion of said tubular body member means being formed with control slot means for receiving said pin projecting inwardly from said control ring, said control slot means being of the zig-zag type and having a plurality of open-ended slot legs each permitting said tubular body member to be lifted to the upper limit of its travel without lifting said key retractor sleeve, said control slot means having at least one short closed-end slot leg for engaging and lifting said key retractor sleeve means, said control slot means being so configured that each time the tubular body member means is lifted relative to said tubular mandrel means, said control ring indexes and causes said control pin to advance to the next control slot leg, said tubular body member means having window means alignable with said flow port means of said tubular mandrel means when said tubular body member means is in its lowermost position relative to said tubular mandrel means;

g. biasing means between said tubular mandrel means and said tubular body member means biasing said tubular body member means downwards relative to said tubular mandrel means; and h. means on said tubular mandrel means engageable with said receptacle to seal between said receptacle and said tubular mandrel means.

2. The test tool of claim 1 further including seal means sealing between said tubular mandrel means and said tubular body member means above and below said flow ports of said tubular mandrel means when said tubular body member means is in its upper position relative to said tubular mandrel means.

3. The test tool of claim 2 wherein said control pin and said control slot means are presettable to provide a preselected number of open/close cycles of the test tool to be performed before the lock keys are automatically disengaged from the receptacle.

4. The test tool of claim 3 wherein when said test tool is withdrawn from said receptacle means upon being automatically released therefrom, said control pin and said control slot means automatically become reset, readying the test tool for immediate reinstallation in said receptacle means for further cycling.

5. The test tool of claim 4 including means for attachment of a pressure gage, or the like tool, to the lower end thereof.

6. The test tool of claim 1, 2, 3, 4, or 5 wherein the end faces of said lock keys converge inwardly and are engageable by shoulder surfaces on the tubular mandrel means which likewise converge inwardly at substantially the same angle whereby a differential pressure acting across the test tool and tending to displace it from the downhole receptacle will cause the inclined shoulder on the tubular mandrel means to coact with the mating inclined surface on the end of the lock key tending to cam the lock key further outwardly.

7. The test tool of claim 6 wherein said means for biasing said tubular body member downward relative to said tubular mandrel means is a coil spring.

8. A landing receptacle for anchoring a test tool in a well, comprising:

a. a main body member having a bore therethrough, lateral port means through the wall thereof intermediate its ends, said bore being reduced in diameter below said lateral port means, said reduced diameter bore being formed with means for receiving a well test tool therein in locked and sealed relation therewith, said main body member being formed with an annular valve seat surface below said lateral port means at the shoulder provided by the upper end of said reduced diameter bore portion;

b. an upper sub member having a bore therethrough and means on its upper end for attachment to a string of well tubing, and having its lower portion reduced in outside diameter, and having an annular seating surface surrounding the lower end of said bore, the reduced diameter portion of said upper sub member being telescoped into the upper end of said main body member and slidable therein between a closed position wherein its seating surface is in engagement with said valve seat surface of said main body member for closing said lateral port means and an open position wherein said seating surface and said valve seat surface are spaced apart to allow flow therebetween;

c. limit means on said main body and said upper sub member coengageable for limiting relative longitudinal movement therebetween; and d. means biasing said main body member toward open position.

9. The landing receptacle of claim 8 wherein said annular valve seat is formed on an annular insert disposed in a counterbore at the upper end of said reduced bore of said main body member and resilient seal means are provided for sealing between said insert and said upper sub member after said valve seat surface engages said annular seating surface, and between said insert and said main body at all times.

10. The landing receptacle of claim 9 wherein said annular insert is mounted in said counterbore for limited longidinal movement relative to said main body and said seal means includes a resilient seal ring having a body portion and a lip portion, said body portion being confined between shoulder means on said insert and said main body, whereby when said main body is moved sufficiently to engage said annular valve seat surface with said seating surface, further movement of said main body causes said body portion of said resilient ring to be compressed and causes said lip portion thereof to be moved into contact with said upper sub member to prevent leakage of fluids between said annular valve surface and said seating surface.

11. The landing receptacle of claim 9 wherein said limit means for limiting longitudinal movement between said main body member and said upper sub member comprises flange means on one and recess means on the other of said main body member and said upper sub member coengageable to limit relative longitudinal movement therebetween, said recess means being wider than said flange.

12. The landing receptacle of claim 11 wherein said flange means comprises:

a. lug members mounted in an internal recess formed in the bore of said main body member and projecting inwardly into said bore and engaged in an annular recess formed in the exterior of said upper sub member; and b. means securing said lug members in said internal recess of said main body member.

13. The device of claim 12 wherein said means for biasing said main body member comprises:

a. downwardly facing external annular shoulder means on said upper sub member provided by said reduction in outside diameter; and b spring means disposed about said reduced outside diameter portion of said upper sub member and having one end thereof bearing against said downwardly facing shoulder of said upper sub member and the other end thereof bearing against the upper end of said main body member.

14. The device of claim 13, wherein said main body member is formed with external downwardly opening longitudinal slot means having their upper ends opening into said lateral port means.

15. The device of claim 13 wherein said restricted bore of said main body member is formed with a plurality of annular flanges and recesses to form a labyrinth type restriction to discourage sand or other particles from settling in the lock mechanism of the test tool when the test tool occupies the landing receptacle.

16. The landing receptacle of claim 8, 9, 10, 11, 12, 13, 14, or 15 including: housing means surrounding said upper sub member and having its upper end closed above said lateral port means, said housing means extending downwardly beyond the lower end of said main body member and having means on its lower end for attachment to a well packer, packer seal nipple, locator sub, well tubing, or the like.

17. Apparatus for testing a well, comprising:

a. bypass landing receptacle means for receiving anchor means therein in locked and sealed relation, said landing receptacle means including:

i a main body member having a bore therethrough and lateral port means intermediate its ends, said bore being reduced in diameter below said lateral port means, said reduced diameter bore being formed with means for receiving anchor means in locked and sealed relation therewith, said main body member being formed with an annular valve seat surface below said lateral port means at the shoulder provided by the upper end of said reduced diameter bore portion; and ii. an upper body member having a bore therethrough and means on at least its upper end for attachment to a string of well tubing, and having its lower portion reduced in outside diameter, and having an annular seating surface surrounding the lower end of said bore, the reduced diameter portion of said upper sub member being telescoped into the upper end of said main body member and slidable therein between a closed position wherein its seating surface is in engagement with said valve seat surface of said main body member for closing said lateral port means and an open position wherein said seating surface and said valve seat surface are spaced apart to allow flow therebetween;

b. anchor means lowerable into said well on a flexible line and anchorable in said main body member of said landing receptacle means in locked and sealed relation therewith, said anchor means being liftable responsive to tensioning said flexible line to lift said main body member to closed position; and c. pressure sensing means associated with said anchor means for sensing well pressure therebelow.

18. The apparatus of claim 17, wherein said flexible line is a conventional wire line and said pressure sensor means is a self-contained recording pressure gauge attached below said anchor means, and said anchor means plugs said landing receptacle below said lateral flow ports.

19. The apparatus of claim 17, wherein said flexible line is a conductor cable and said sensor senses well pressure below said well packer and transmits signals to recording and/or readout equipment at the surface through said conductor cable.

20. Apparatus for testing a well, comprising:

a. a landing receptable for anchoring a test tool therein, comprising:

i. a main body member having a bore therethrough and lateral port means intermediate its ends, said bore being reduced in diameter below said lateral port means, said reduced diameter bore being formed with means for receiving a test tool in locked and sealed relation therewith, said main body member being formed with an annular valve seat surface below said lateral port means at the shoulder provided by the upper end of said reduced diamter bore portion;

ii. an upper sub member having a bore therethrough and means on its upper end for attachment to a string of well tubing, and having its lower portion reduced in outside diameter, and having an annular seating surface surrounding the lower end of said bore, the reduced diameter portion of said upper sub member being telescoped into the upper end of said main body member and slidable therein between a closed position wherein its seating surface is in engagement with said valve seat surface of said main body member for closing said lateral port means and an open position wherein said seating surface and said valve seat surface are spaced apart to allow flow therebetween;

iii. means on said main body and said upper sub member coengageable for limiting relative longitudinal movement therebetween;

iv. means biasing said main body member toward opening position; and b. a test tool suspended in said well on a flexible line and lockingly and sealingly engaged in said landing receptacle, said test tool having a flow passage therethrough, said test tool comprising:

i. tubular mandrel means;

ii. lock keys mounted on said tubular mandrel means and configured to engage in said landing receptacle, said keys being movable between retracted and expanded positions, said keys having retraction cam means thereon;

iii. means biasing said keys outwardly toward expanded position;

iv. key retractor sleeve means slidably mounted on said tubular mandrel means and having cam means thereon engageable with said lock keys to retract them to unlocked position responsive to upward movement of said key retractor sleeve means relative to said tubular mandrel means;

v. tubular body member means having means on one end thereof connected to said flexible line and having its other end telescoped over the upper end portion of said tubular mandrel means for limited longitudinal movement relative thereto, said tubular body member means having its lower end portion reduced in diameter and telescoped into the upper end portion of said key retractor sleeve means, and operatively connected thereto;

vi. valve means in said test tool for controlling fluid flow through said flow passage thereof, said valve being movable between open and closed positions responsive to axial movement of said tubular body means relative to said tubular mandrel means in response to tensioning and relaxing said flexible line, said tensioning and relaxing of said flexible line also causing said lateral port means of said landing receptacle to open and close; and vii. biasing means between said tubular mandrel means and said tubular body member means biasing said tubular body member means downward relative to said tubular mandrel means toward open position.

21. The device of claim 20 wherein said means for receiving a well test tool in locked and sealed relation includes:

a. a pair of internal annular recesses providing a pair of oppositely facing abrupt lock shoulders therebetween; and b. a smooth-wall bore portion below said pair of internal annular recesses.

22. The apparatus of claim 20 or 21, wherein said test tool includes pressure sensing means.

23. The apparatus of claim 22, wherein said flexible line is a conventional wire line and said pressure sensing means is a self-contained recording pressure gauge carried below said lock keys.

24. The apparatus of claim 22, wherein said flexible line is a conductor cable and said pressure sensor means senses well pressure below said test tool and transmits signals to recording and/or readout equipment at the surface through said conductor cable.

25. A method of testing a well having casing therein, said casing being perforated opposite an earth formation to be tested, said method including the steps of:

a. lowering a string of well tubing into the well, said well tubing including a well packer and a landing receptacle, said landing receptacle having lateral flow ports communicating the interior of the well tubing with the exterior thereof below said well packer;

b. setting said well packer above said casing perforations;

c. lowering a test tool having anchor means into said well tubing on a flexible line and anchoring said anchoring means in said receptacle, said test tool having a flow passage therethrough extending upwardly from an inlet below said anchor means to an outlet thereabove, and valve means controlling flow through said flow passage;

d. flowing the well;

e. tensioning said flexible line to actuate said landing receptacle to close its lateral flow ports and to close said flow passage through said test tool to stop fluid flow through said landing receptacle;

f. relaxing tension on said flexible line and pressurizing said well tubing above said landing receptacle to open said lateral flow ports and to open said flow passage through said test tool; and g. releasing said anchor means from said landing receptacle and removing it from the well.

26. The method of claim 25, wherein said landing receptacle is located below said well packer.

27. The method of claim 25, wherein said landing receptacle is located above said well packer with the lateral flow ports thereof in fluid communication with the exterior of the tubing below said well packer.

28. The method of claim 26 or 27, wherein said flexible line is a conventional wire line and said pressure sensor means is a self-contained recording pressure gauge attached below said anchor means, and said anchor means plugs said landing receptacle below said lateral flow ports.

29. The method of claim 23 or 24, wherein said flexible line is a conductor cable and said sensor means senses well pressure below said well packer and transmits signals to recording and/or readout equipment at the surface through said conductor line.

30. A method of testing a well having casing therein, said casing being perforated opposite an earth formation to be tested, said method including the steps of:

a. lowering a string of well tubing into the well, said tubing including a well packer and a landing receptacle therebelow, said landing receptacle being open at its lower end and having lateral port means intermediate its ends, said lateral port means being closable and openable;

b. setting said packer above said perforations with the lateral port means of said landing receptacle at or near said perforations;

c. lowering a test tool assembly having lock means thereon into said well tubing on a conductor cable and anchoring the lock means in said landing receptacle, said test tool assembly including sensor means for sensing well pressures and/or temperatures, and a test tool connected therebelow, said test tool communicating well pressure to said sensor means at all times, said test tool having a flow passage therethrough extending from an inlet below said lock means upwardly to an outlet thereabove and having valve means controlling flow therethrough, said valve being movable between open and closed positions responsive to tensioning and relaxing said conductor cable;

d. tensioning said cable to close said flow passage through said test tool and said lateral port means in said landing receptacle and allowing well pressure to build up below the packer;

e. relaxing tension on the cable to open the flow passage through said test tool to first equalize pressures thereacross and to open the lateral port means of the receptacle and flowing the well; and f. subsequently releasing the test tool from the landing receptacle and withdrawing the test tool assembly from the well.

31. The method of claim 30 wherein steps d and e are repeated before withdrawing the test tool assembly from the well.

32. The method of claim 31 wherein said test tool upon automatically releasing from said landing receptacle is re-installed therein for further testing of the well before withdrawing the test tool assembly from the well.

33. The method of claim 30 wherein said test tool is provided with lock means which automatically locks said test tool in said landing receptacle upon said test tool being inserted therein.

34. The method of claim 33 wherein said lock means of said test tool will automatically release from said landing receptacle when said test tool has been opened and closed a predetermined number of times.

35. A method of testing a well having casing therein, said casing being perforated opposite an earth formation to be tested, there being a packer set in the casing above the perforations and having a bore therethrough, said method including:

a. lowering a string of well tubing into the well, said well tubing including seal means adjacent its lower end for sealingly engaging the internal wall of said packer bore and a bypass landing receptacle above said seal means, said bypass landing receptacle having lateral bypass ports through its wall, said receptacle being surrounded by a housing having its upper end closed above said lateral ports and having its lower end attached to the upper end of said seal means to communicate the bore of the well tubing below said bypass landing receptacle with the interior of said receptacle;

b. landing said string of well tubing in the well with the seals adjacent its lower end sealingly engaged in the bore of said packer;

c. lowering a test tool into said well tubing on a conductor cable or wire line and anchoring the same in said bypass landing receptacle, said test tool having a flow passage therethrough and valve means controlling flow through said flow passage, said valve being movable between open and closed positions responsive to tensioning and relaxing said cable or wire line;

d. tensioning said wire line or cable to close said test tool and said lateral bypass ports of said bypass landing receptacle and allowing pressure to build up below said packer;

e. relaxing said cable or wire line to open said test tool to first substantially equalize pressures thereacross and to open said lateral bypass ports of said bypass landing receptacle and flowing the well; and f. releasing said test tool from said bypass landing receptacle and withdrawing the test tool from said well tubing.

36. The method of claim 35 wherein steps d and e are repeated before withdrawing the test tool assembly from the well.

37. The method of claim 35 wherein said test tool is provided with lock means which automatically locks said test tool in said landing receptacle upon said test tool being inserted therein.

38. The method of claim 37 wherein said lock means of said test tool will automatically release from said bypass landing receptacle when said test tool has been opened and closed a predetermined number of times.

39. The method of claim 38 wherein said test tool upon automatically releasing from said bypass landing receptacle is re-installed therein for further testing of the well before withdrawing the test tool assembly from the well.

40. A method of testing a well having casing therein, said casing being perforated opposite an earth formation to be tested, said method including the steps of:

a. lowering a string of well tubing into the well, said well tubing including a well packer adjacent its lower end and a bypass landing receptacle above said packer, said receptacle having lateral port means, said landing receptacle being surrounded by a housing having its upper end closed above said lateral port means and having its lower end attached to the upper end of said well packer;

b. setting said well packer above said casing perforations;

c. lowering a test tool assembly into said well tubing on a flexible line and anchoring it in said landing receptacle, said test tool having a flow passage therethrough and including valve means movable between open and closed positions responsive to tensioning and relaxing said flexible line, said bypass landing receptacle having lateral port means also openable and closable in response to tensioning and relaxing said flexible line when said test tool is anchored in said receptacle;

d. tensioning said flexible line to close said test tool and the lateral port means of said receptacle and allowing pressure to build up below said packer;

e. relaxing tension on said flexible line to open said test tool to first reduce pressures thereacross and subsequently open said lateral port means as pressures thereacross approach equalization, and flowing the well; and f. releasing the test tool from the landing receptacle and withdrawing it from the well.

41. The method of claim 40 wherein steps d and e are repeated before withdrawing the test tool assembly from the well.

42. The method of claim 40 wherein said test tool is provided with lock means which automatically locks said test tool in said landing receptacle upon said test tool being inserted therein.

43. The method of claim 42 wherein said lock means of said test tool will automatically release from said landing receptacle when said test tool has been opened and closed a predetermined number of times.

44. The method of claim 43 wherein said test tool upon automatically releasing from said landing receptacle is re-installed therein for further testing of the well before withdrawing the test tool assembly from the well.

45. A well installation, including:

a. a well bore penetrating an earth formation;

b. a string of casing in said well bore, the bore of said casing being in fluid communication with said earth formation;

c. a string of well tubing in said casing, the lower end of said tubing being in fluid communication with said casing bore at a location adjacent said earth formation;

d. a well packer sealing between said tubing and said casing above said point of communication of said casing bore with said earth formation;

e. bypass landing receptacle means forming a portion of said tubing string, said bypass landing receptacle means including:

i. a main body member having a bore therethrough and lateral flow ports intermediate its ends, said main body member bore being adapted to receive a well test tool therein in locked and sealed relation therewith, said locking and sealing being at a point below said lateral flow ports, ii. an end sub mounted in telescoping relation with said main body member for limited sliding movement between extended and retracted positions, iii. seating surfaces on said end sub and said main body member coengageable to close said lateral flow ports when said end sub and said main body member are in retracted position, and iv. biasing means tending to hold said receptacle extended and said lateral flow ports open; and f. well test tool means lockingly and sealingly engaged in said main body member of said landing receptacle and having its upper end attached to a flexible line extending upwardly to the surface, said flexible line being utilizable to manipulate said well test tool means to open and close said lateral flow ports of said landing receptacle to permit or prevent the flow of well fluids therefrom.

46. The installation of claim 45, wherein said well test tool means has a flow passage therethrough and valve means in said flow passage movable between open and closed positions in response to tensioning and relaxing said flexible line such that both the test tool means and the lateral flow ports of said receptacle can be held open at the same time to permit the well to flow therethrough and closed at the same time to hold the well shut-in.

47. The installation of claim 45, wherein said well packer is located above said landing receptacle.

48. The installation of claim 45, wherein said well packer is located below said landing receptacle.

49. The installation of claim 48, wherein said well tubing is provided with packer seal nipple means below said landing receptacle and is sealingly engaged in the bore of an existing packer installed in the well before lowering said well tubing thereinto.

* * * * *

UNITED STATES PATENT AND TRADEMARK OFFICE

CERTIFICATE OF CORRECTION

PATENT NO. : 4,583,592

DATED : April 22, 1986

INVENTOR(S) : Imre I. Gazda and Phillip S. Sizer

It is certified that error appears in the above—identified patent and that said Letters Patent is hereby corrected as shown below:

For the paragraph beginning at Column 3, line 64 and running through Column 4, line 17, read --The present invention is directed to apparatus and methods for testing wells by controlling flow therefrom at a location above but adjacent the earth formation to be tested including opening the well to flow and then shutting it in, and sensing the well pressures below such control point during flowing and/or shut-in periods, the test apparatus including a landing receptacle in the well conduit and adjacent a well packer, and a test tool lowerable into the well on a flexible line and locked and sealed in the receptacle, the test tool and receptacle being used to open and close the well in response to tensioning and relaxing the flexible line. In one aspect of the invention, the receptacle is provided with lateral bypass flow ports which are opened and closed as a result of tensioning and relaxing the flexible line. The flexible line may be an electrical conductor line or a conventional wire line, and the pressure sensing device may be a recording pressure gauge or an electronic sensor which senses well

UNITED STATES PATENT AND TRADEMARK OFFICE

CERTIFICATE OF CORRECTION

PATENT NO. : 4,583,592

DATED : April 22, 1986

INVENTOR(S) : Imre I. Gazda and Phillip S. Sizer

It is certified that error appears in the above—identified patent and that said Letters Patent is hereby corrected as shown below:

pressures, generates electrical signals and sends them via the conductor line to the surface for processing and real-time recording and/or readout.--

Signed and Sealed this

Twenty-ninth Day of September, 1987

*Attest:*

DONALD J. QUIGG

*Attesting Officer* *Commissioner of Patents and Trademarks*